US011300331B2

(12) United States Patent
Choi et al.

(10) Patent No.: US 11,300,331 B2
(45) Date of Patent: Apr. 12, 2022

(54) THERMOELECTRIC REFRIGERATOR

(71) Applicant: LG ELECTRONICS INC., Seoul (KR)

(72) Inventors: Jeehoon Choi, Seoul (KR); Seokhyun Kim, Seoul (KR); Heayoun Sul, Seoul (KR); Minkyu Oh, Seoul (KR); Hyoungkeun Lim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/924,741

(22) Filed: Mar. 19, 2018

(65) Prior Publication Data

US 2018/0274825 A1 Sep. 27, 2018

(30) Foreign Application Priority Data

Mar. 21, 2017 (KR) ..... 10-2017-0035608

(51) Int. Cl.
*F25B 21/02* (2006.01)
*F25D 11/00* (2006.01)
(Continued)

(52) U.S. Cl.
CPC ..... *F25B 21/02* (2013.01); *F25D 11/00* (2013.01); *F25D 19/00* (2013.01); *F25D 21/14* (2013.01);
(Continued)

(58) Field of Classification Search
CPC ..... F25B 21/02; F25B 2321/0251; F25B 2321/0252; F25D 11/00; F25D 23/066;
(Continued)

(56) References Cited

U.S. PATENT DOCUMENTS 2,994,209 A * 8/1961 Mann ..... F25D 17/062 62/215
3,194,023 A * 7/1965 Sudmeier ..... F25B 21/02 62/3.62
(Continued)

FOREIGN PATENT DOCUMENTS

CN 201221885 Y 4/2009
CN 202008993 U 10/2011
(Continued)

OTHER PUBLICATIONS

"Black or chrome wire fan guards Protect PC Computer cooling fan", Nov. 15, 2014, https://web.archive.org/web/20141115134717/http://www.fanguards.org/fanguard/fan-guard.html (Year: 2014).*
(Continued)

*Primary Examiner* — Christopher R Zerphey
(74) *Attorney, Agent, or Firm* — Ked & Associates, LLP

(57) ABSTRACT

A refrigerator including an inner case having a storage chamber defined therein; a thermoelectric module configured to cool the storage chamber, wherein the thermoelectric module includes a thermoelectric element and a heat sink; a heat-dissipation fan assembly provided adjacent to the heat sink; a heat-dissipation cover spaced apart from the inner case, wherein the heat-dissipation cover has at least one outer intake hole defined therein and wherein the intake hole faces the heat-dissipation fan assembly; and a gasket configured to block a gap between the heat-dissipation cover and the heat-dissipation fan assembly.

8 Claims, 22 Drawing Sheets

(51) Int. Cl.

| | |
|---|---|
| ***F25D 19/00*** | (2006.01) |
| ***F25D 21/14*** | (2006.01) |
| ***F25D 23/00*** | (2006.01) |
| ***F25D 23/06*** | (2006.01) |
| ***F25D 17/06*** | (2006.01) |
| ***F25D 15/00*** | (2006.01) |
| ***F25D 23/02*** | (2006.01) |

(52) U.S. Cl.
CPC ..... *F25D 23/003* (2013.01); *F25D 23/066* (2013.01); *F25B 2321/0251* (2013.01); *F25B 2321/0252* (2013.01); *F25D 17/062* (2013.01); *F25D 2500/02* (2013.01)

(58) Field of Classification Search
CPC ..... F25D 17/062; F25D 2321/0251; F25D 21/02; F25D 2323/00274; F24F 5/0042; H05K 7/20172; F04D 29/70–703
See application file for complete search history.

(56) References Cited

U.S. PATENT DOCUMENTS

| | | | | | |
|---|---|---|---|---|---|
| 4,297,850 | A * | 11/1981 | Reed | F25B 21/04 | 62/262 |
| 4,326,383 | A * | 4/1982 | Reed | F25B 21/02 | 62/3.62 |
| 4,472,945 | A * | 9/1984 | Cech | H01L 35/30 | 62/3.3 |
| 4,913,713 | A * | 4/1990 | Bender | B67D 1/06 | 222/146.6 |
| 4,970,874 | A * | 11/1990 | Solak | F25D 23/00 | 312/116 |
| 5,315,830 | A * | 5/1994 | Doke | F25B 21/02 | 62/3.2 |
| 5,316,423 | A | 5/1994 | Kin | | |
| 5,398,510 | A * | 3/1995 | Gilley | F25B 21/02 | 62/3.6 |
| 5,501,076 | A * | 3/1996 | Sharp, III | F25B 21/02 | 62/3.2 |
| 5,678,421 | A * | 10/1997 | Maynard | A47F 3/0408 | 62/279 |
| 6,082,310 | A * | 7/2000 | Valcic | F23D 14/72 | 122/13.01 |
| 6,250,083 | B1 * | 6/2001 | Chou | F24F 3/14 | 62/3.4 |
| 6,894,897 | B1 | 5/2005 | Nagurny et al. | | |
| 10,660,821 | B2 * | 5/2020 | Tsuno | F25B 21/04 | |
| 2006/0045616 | A1 | 3/2006 | Sura et al. | | |
| 2007/0085248 | A1 | 4/2007 | Chang | | |
| 2007/0193280 | A1 | 8/2007 | Tuskiewicz et al. | | |
| 2010/0002389 | A1 * | 1/2010 | Tung | H05K 7/20172 | 361/697 |
| 2010/0242523 | A1 | 9/2010 | Rubright | | |
| 2017/0276421 | A1 * | 9/2017 | Candeo | F04D 29/601 | |

FOREIGN PATENT DOCUMENTS

| | | | | | |
|---|---|---|---|---|---|
| CN | 202531449 | U | | 11/2012 | |
| DE | 2648237 | A1 | * | 5/1977 | F25D 19/00 |
| EP | 2 762 994 | A1 | | 8/2014 | |
| JP | 04214170 | A | * | 8/1992 | F25D 23/10 |
| JP | H 07-119858 | A | | 5/1995 | |
| JP | H 11-118313 | A | | 4/1999 | |
| JP | 2002-271071 | | | 9/2002 | |
| JP | 2003279224 | A | * | 10/2003 | F25D 21/14 |
| JP | 2004-104035 | | | 4/2004 | |
| JP | 2011-171587 | A | | 9/2011 | |
| KR | 20-1999-0017197 | | | 5/1999 | |
| KR | 10-2007-0102256 | | | 10/2007 | |
| KR | 10-2009-0114261 | | | 11/2009 | |
| RU | 2137260 | | | 9/1999 | |
| RU | 2203457 | | | 4/2003 | |

OTHER PUBLICATIONS

International Search Report dated Jul. 31, 2018 issued in PCT/KR2018/003056.
Russian Office Action dated Apr. 23, 2020 issued in RU Application No. 2019133110.
Japanese Office Action dated Sep. 15, 2020 issued in Application 2019-572334.
Extended European Search Report dated Nov. 9, 2020 issued in Application 18770649.4.
Chinese Office Action dated Nov. 10, 2020 issued in Application 201880017634.4.
Japanese Office Action dated Feb. 16, 2021 issued in Application 2019-572334.

* cited by examiner

THERMOELECTRIC REFRIGERATOR

CROSS-REFERENCE TO RELATED APPLICATION(S)

The present application claims a benefit of Korean patent application No. 10-2017-0035608, filed in Korea on Mar. 21, 2017 under 35 U.S.C. 119 (35) and 365 (35), the entire content of which is incorporated herein by reference for all purposes as if fully set forth herein.

BACKGROUND

1. Field

A refrigerator, and more particularly a refrigerator in which a storage chamber is cooled by a thermoelectric module is disclosed herein.

2. Background

A refrigerator may keep food or medicine cool or at a low temperature to prevent corruption thereof. The refrigerator may include a storage chamber in which food or medicine is stored, and a cooling unit to cool the storage chamber. An example of the cooling unit may include a refrigeration cycle unit including a compressor, a condenser, an expander, and an evaporator.

Another example of such a cooling unit may include a thermoelectric module (TEM) wherein when different metals are combined and current flows through the metals, a temperature difference occurs on both sides of the different metals. The refrigeration cycle unit may be more efficient than the thermoelectric module, but may have a disadvantage in that the compressor operates at a high noise level. Conversely, the thermoelectric module may be less efficient than the refrigeration cycle unit, but may have the advantage of less noise. Thus, the thermoelectric module may be utilized in a CPU cooling device, a temperature control seat of a vehicle, a small refrigerator, and the like.

BRIEF DESCRIPTION OF THE DRAWINGS

Embodiments will be described in detail with reference to the following drawings in which like reference numerals refer to like elements, and wherein.

DETAILED DESCRIPTION

Figure 1:
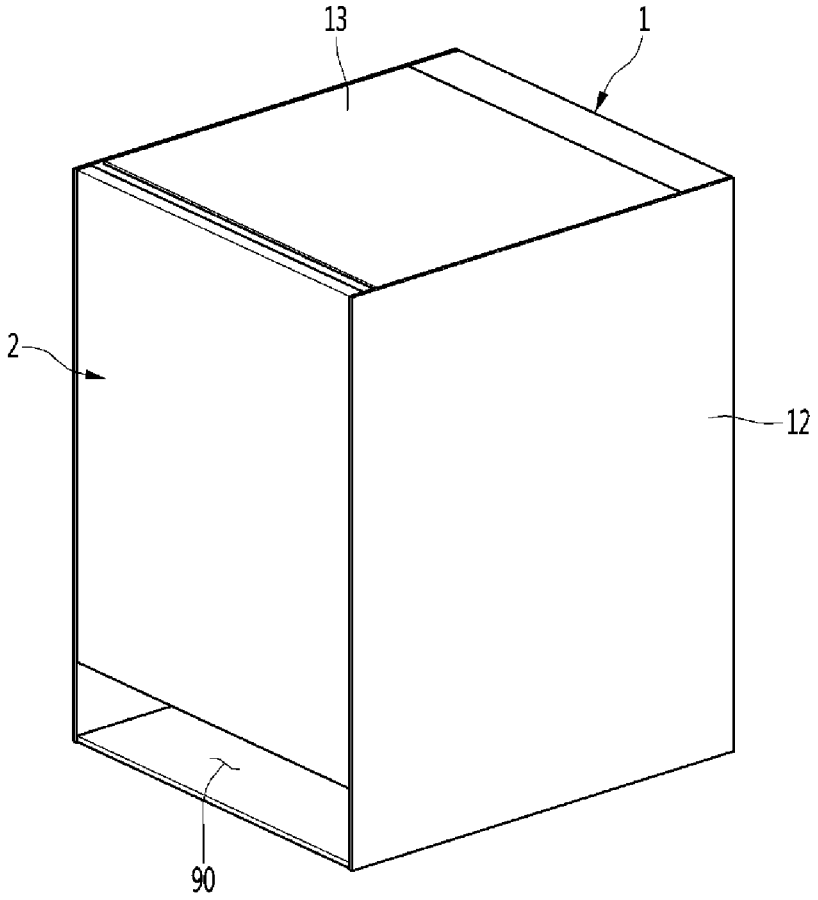
FIG. 1 is a perspective view showing the appearance of the refrigerator according to an embodiment of the present disclosure.
Figure 2:
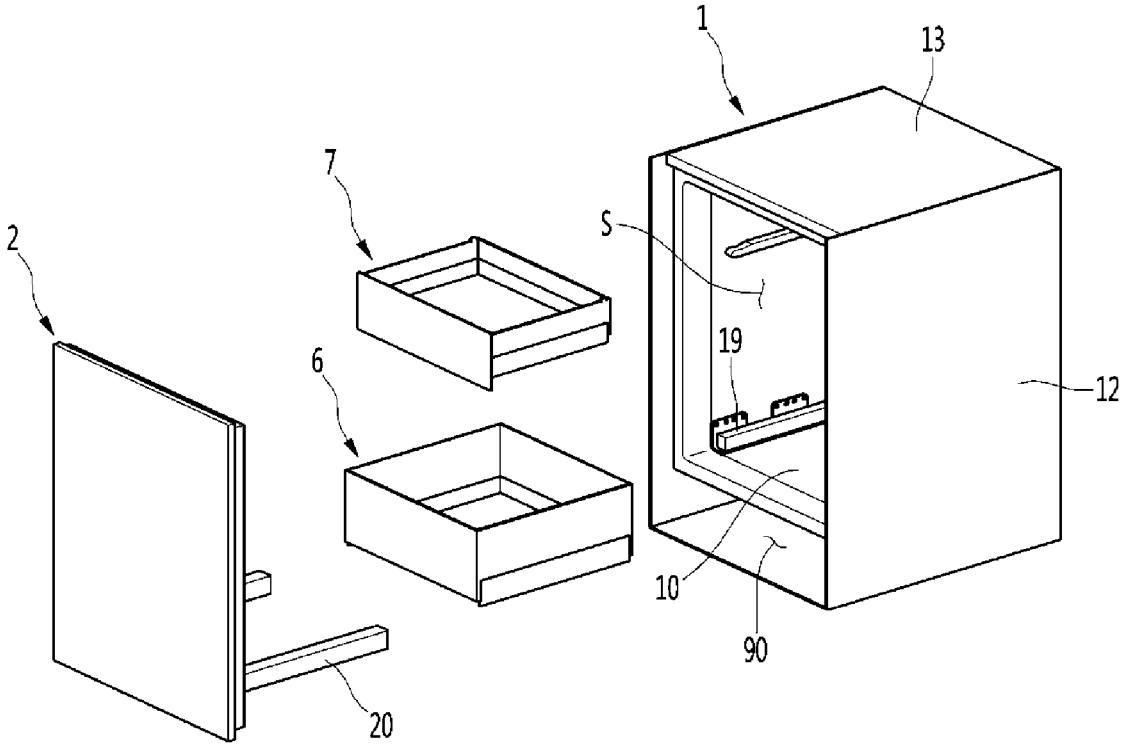
FIG. 2 is an exploded perspective view in which the refrigerator's main body, the door, and the storage compartment are separated from each other, according to an embodiment.
Figure 3:
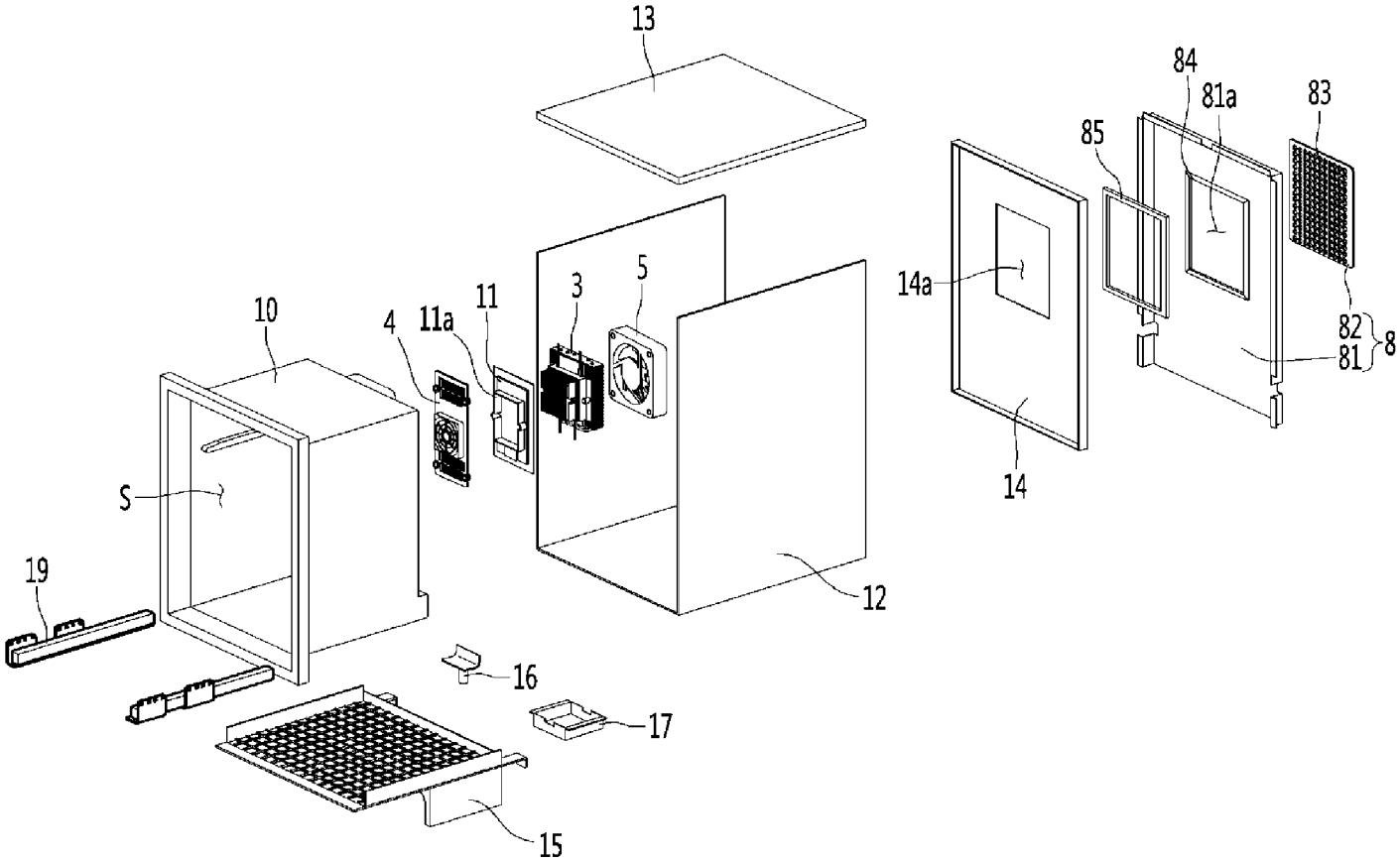
FIG. 3 is an exploded perspective view of the main body of the refrigerator according to an embodiment.
Figure 4:
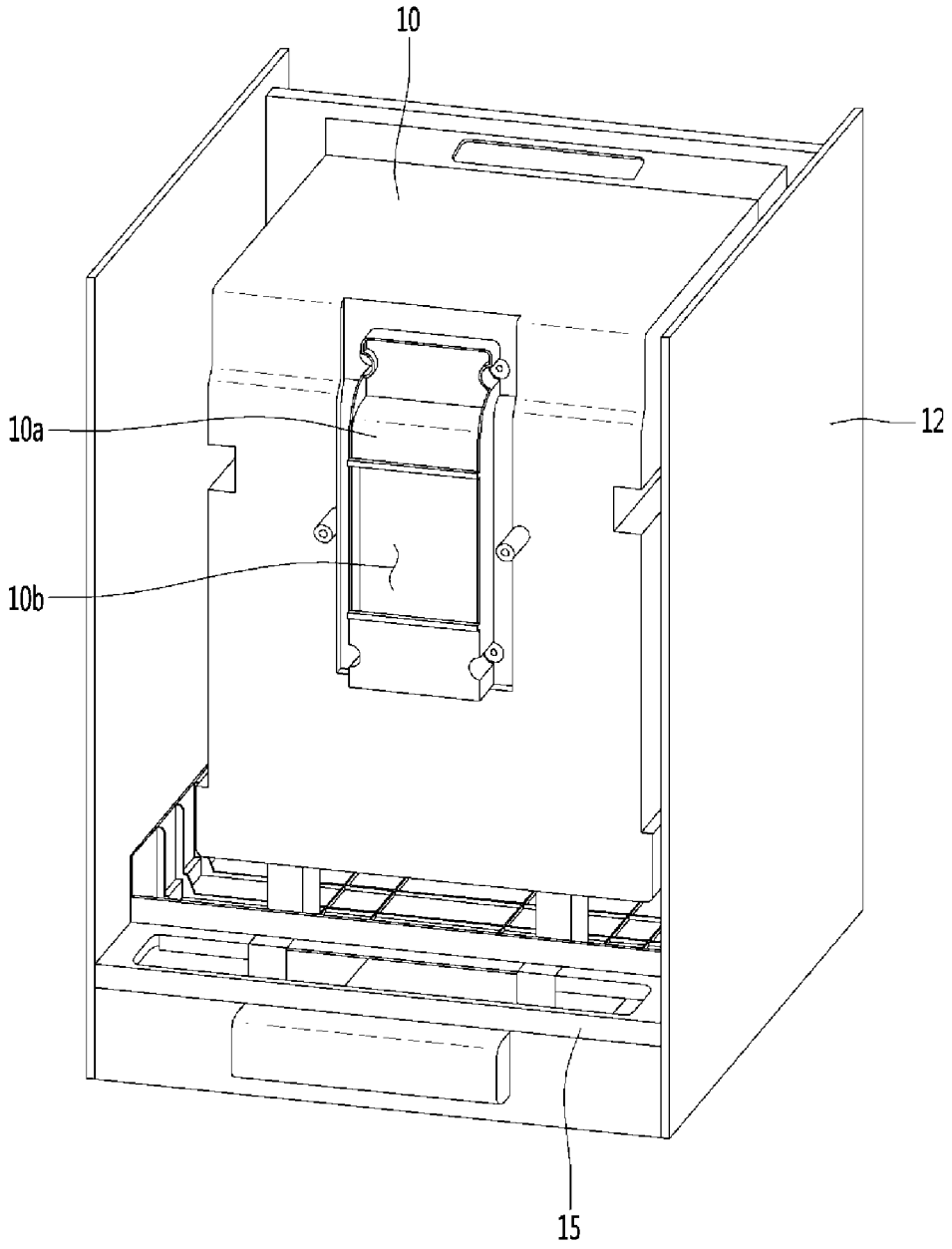
FIG. 4 is a perspective view of the back face of the inner case according to an embodiment.
Figure 5:
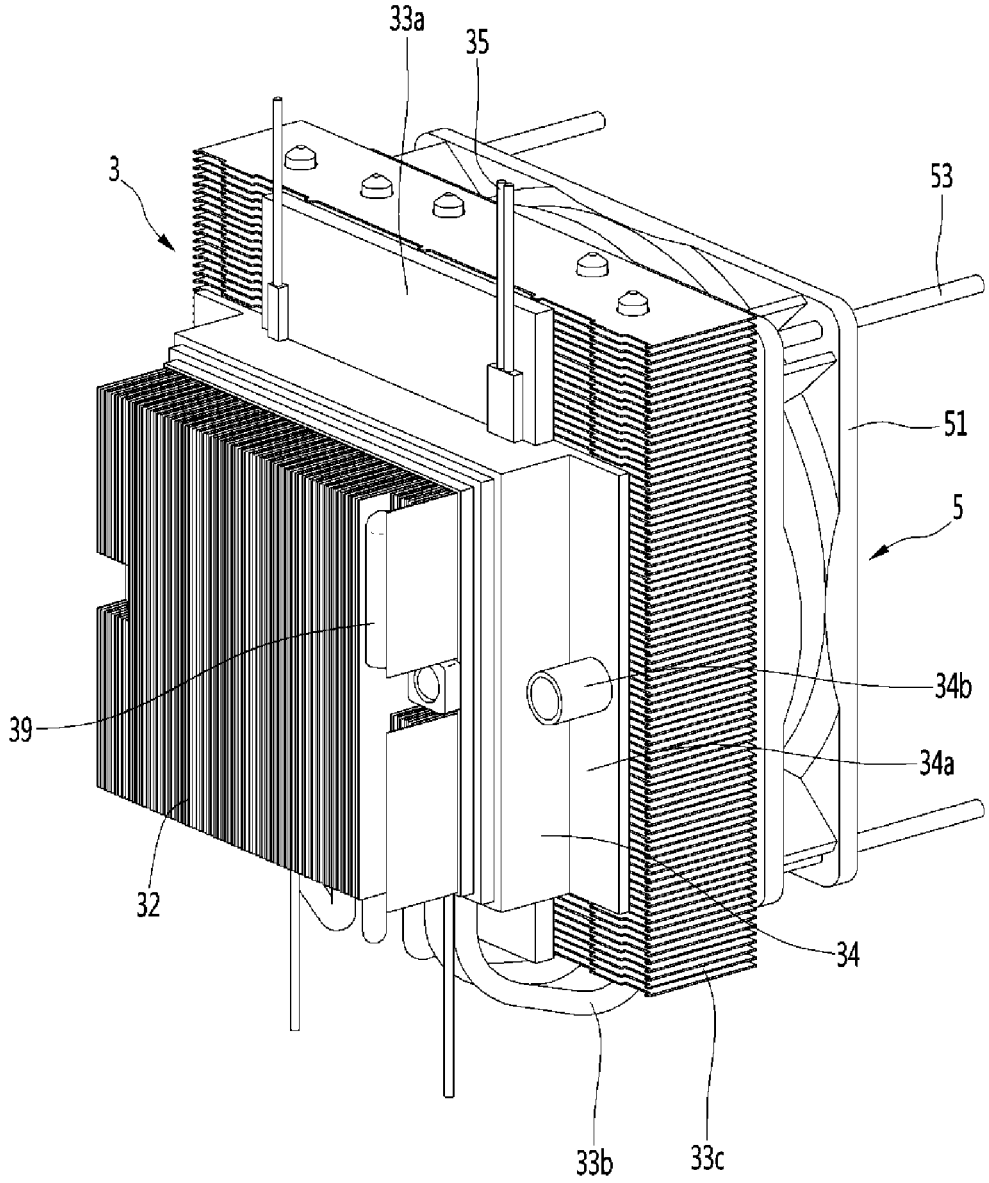
FIG. 5 is a perspective view of the thermoelectric module and heat-dissipation fan according to an embodiment.

FIG. 1 is a perspective view showing an appearance of a refrigerator according to an embodiment of the present disclosure. FIG. 2 is an exploded perspective view in which the refrigerator's main body, the door, and the storage compartment are separated from each other. FIG. 3 is an exploded perspective view of the main body of the refrigerator.

Referring to FIGS. 1 to 4, the refrigerator according to an embodiment may include a main body 1 having a storage chamber S defined therein, a door 2 configured to open and close the storage chamber S, and a thermoelectric module 3 to cool the storage chamber S. The main body 1 may be formed in a box shape. The height of the main body 1 may be 400 mm or more and 700 mm or less so that the refrigerator may be utilized as a side table type refrigerator. That is, the height of the refrigerator may be between 400 mm and 700 mm.

The top face of the main body 1 may be horizontal. The user may use the top face of main body 1 as the top face of the side table. The main body 1 may be composed of a combination of a plurality of members.

The main body 1 may include an inner case 10, a cabinet 12, 13, 14, a cabinet bottom 15, a drain pipe 16, and a tray 17. The main body 1 may further include a PCB cover 18 and a heat dissipation cover 8.

In the inner case 10, the storage chamber S may be provided. The storage chamber S may define the inner space of the inner case 10. One side face of the inner case 10 may be open. The opened side face may be opened and closed by the door 2. The front face of the inner case 10 may be opened.

A thermoelectric module mount 10*a* may be formed on the rear face of the inner case 10. The thermoelectric module mount 10*a* may be formed by protruding a portion of the back face of the inner case 10 rearward. The thermoelectric module mount 10*a* may be formed closer to a top face of the inner case than the bottom face of the inner case 10.

In the inner space of the thermoelectric module mount 10*a*, a cooled-air flow channel S1 (see FIG. 16) may be provided. The cooled-air flow channel S1 may define the inner space of the thermoelectric module mount 10*a* and may communicate with the storage chamber S.

Further, the thermoelectric module mount 10*a* may have a thermoelectric module mounting hole 10*b* defined therein. At least a portion of a cooling sink 32, described below, of the thermoelectric module 3 may be arranged within the cooled-air flow channel S1.

The cabinet 12, 13 and 14 may constitute at least a part of the appearance of the refrigerator. The cabinet 12, 13, 14 may surround the outer circumference of the inner case 10. The cabinet 12, 13, 14 may be spaced apart from the inner case 10. Foam may be inserted between the cabinet 12, 13, 14 and the inner case 10.

The cabinet 12, 13, 14 may be formed of a combination of a plurality of members. The cabinet 12, 13, 14 may include an outer cabinet 12, a top cover 13, and a back plate 14. The outer cabinet 12 may partially surround the inner case 10. More specifically, the outer cabinet 12 may be located to the left, right, and bottom of the inner case 10. However, the positional relationship between the outer cabinet 12 and the inner case 10 may be varied as needed.

The outer cabinet 12 may be arranged to cover the left, right, and bottom faces of the inner case 10. The outer cabinet 12 may be spaced apart from the inner case 10. The outer cabinet 12 may define the left, right, and bottom faces of the refrigerator. The outer cabinet 12 may have a plurality of members.

The outer cabinet 12 may include a base that forms the bottom face appearance of the refrigerator, a left cover that is placed on the left side of the base, and a right cover that is placed on the right side of the base. In this case, at least one of the base, left cover and right cover may be made of different material. For example, the base may be formed of a synthetic resin material while the left plate and the right plate may be formed of metal such as steel or aluminum.

The outer cabinet 12 may also be composed of a single member. In this case, the outer cabinet 12 may have a lower plate, a left plate, and a right plate as a single piece bent to partially surround the inner case 10. When the outer cabinet 12 is composed of a single member, the outer cabinet may be formed of a metal such as steel or aluminum.

The top cover 13 may be provided on top of the inner case 10. The top cover 13 may define the top face of the refrigerator. The user may use the top face of top cover 13 as the top face of the side table.

The top cover 13 may be formed in a plate shape. The top cover 13 may be formed of a wood material. As a result, the appearance of the refrigerator may be made more aesthetic. Further, single wood may be used in common side tables, the user may feel the refrigerator more intuitively as a side table.

The top cover 13 may cover the top face of the inner case 10. At least a portion of the top cover 13 may be spaced apart from the inner case 10. The top face of the top cover 13 may be positioned precisely aligned with the top of the outer cabinet 12. The horizontal width of the top cover 13 may be the same as the inner horizontal width of the outer cabinet 12. The left and right sides of the top cover 13 may be in contact with the inner surface of the outer cabinet 12.

The back plate 14 may be vertically arranged vertically. The back plate 14 may be provided behind the inner case 10 and below the top cover 13. The back plate 14 may face the rear of the inner case 10 in a rear-front direction.

The back plate 14 may be in contact with the inner case 10. The back plate 14 may be provided close to the thermoelectric module mount 10*a* of the inner case 10.

The back plate 14 may have a through-hole 14*a* defined therein. The hole 14*a* may be formed at a position corresponding to the thermoelectric module mounting hole 10*b* in the inner case 10. The size of the through-hole 14*a* may be greater than or equal to the size of the thermoelectric module mounting hole 10*b* in the inner case 10.

A cabinet bottom 15 may be located below the inner case 10. The cabinet bottom 15 may support the inner case 10. The cabinet bottom 15 may be provided between the outer bottom face of the inner case 10 and the inner bottom face of the outer cabinet 12. The cabinet bottom 15 may separate the inner case 10 from the inner bottom face of the outer cabinet 12. The cabinet bottom 15, along with the inner face of the outer cabinet 12, may define a lower dissipated-heat flow channel 92 (see FIG. 16).

The drain pipe 16 may communicate with the storage chamber S. The drain pipe 16 may be connected to a lower portion of the inner case 10. The drain pipe 16 may discharge water generated by defrosting or the like in the inner case 10. The tray 17 may be positioned below the drain pipe 16 and may receive water dropped from the drain pipe 16.

The tray 17 may be arranged between the cabinet bottom 15 and the outer cabinet 12. The tray 17 may be located within the lower dissipated-heat flow channel 92 (see FIG. 16). The water contained in the tray 17 may be evaporated by hot air guided to the lower dissipated-heat flow channel 92. Due to this configuration, the water in the tray 17 may not need to be frequently emptied.

The heat dissipation cover 8 may be arranged behind the back plate 14. The heat dissipation cover 8 may face the back plate 14 in a rear-front direction. The heat-dissipation cover 8 may be spaced apart from the back plate 14. The heat-dissipation cover 8 may be arranged vertically.

The top of the heat-dissipation cover 8 may be spaced apart from the top cover 13. That is, the height of the heat dissipation cover 8 may be lower than the height of the outer cabinet 12. In this case, the PCB cover 18 may be exposed in the rear direction of the main body 1.

However, the present disclosure is not limited thereto. The top of the heat-dissipation cover 8 may be in contact with the top cover 13. In this case, the PCB cover 18 may be positioned in front of the heat-dissipation cover 8 and may not be exposed in the backward direction of the main body 1.

The heat dissipation cover 8 may include a cover body 81 and a suction grill 82 mounted on the cover body 81. The cover body 81 and the suction grill 82 may be integrally formed or formed of separate members. The cover body 81 may define a rear face of the refrigerator. The heat dissipation cover 8 may have at least one outer intake hole 83 defined therein.

In the suction grill 82, a plurality of the outer intake holes 83 may be formed. The outer intake hole 83 may face a heat-dissipation fan assembly 5. When the heat-dissipation fan assembly 5 is driven, the outside air may be sucked into the heat-dissipation fan assembly 5 through the outer intake hole 83. The size and shape of the outer intake hole 83 may vary as needed.

The suction grill 82 may serve as a finger guard to prevent the user's fingers from accessing the heat-dissipation fan assembly 5. The outer intake hole 83 may be sized such that the user's finger may not be inserted therein.

The cover body 81 may have a cover through-hole 81*a* defined therein. The cover through-hole 81*a* may be formed at a position facing the heat-dissipation fan assembly 5. The cover through-hole 81*a* may be positioned between the suction grill 82 and the heat-dissipation fan assembly 5. The air sucked through the outer intake hole 83 may be sucked into the heat-dissipation fan assembly 5 through the cover through-hole 81*a*.

The suction grill 82 may cover the cover through-hole 81. The suction grill 82 may face the heat-dissipation fan. More specifically, the front face of the suction grill 82 may face the heat-dissipation fan assembly 5 in the rear-front direction.

The suction grill 82 may be spaced apart from the heat-dissipation fan assembly 5. The separation distance between the suction grill 82 and the heat-dissipation fan assembly 5 may be greater than the front maximum elastic deformation length of the suction grill 82. Thus, even when the user manually pushes the suction grill 82, the suction grill 82 may not touch the heat-dissipation fan assembly 5.

The cover body 81 may have a depressed portion 84. The depressed portion 84 may be depressed backward from the cover body 81. The depressed portion 84 may be formed by depressing a portion of the cover body 81 rearward.

The cover through-hole 81*a* may be defined in the depressed portion 84. The suction grill 82 may be mounted on the depressed portion 84. When the cover body 81 includes the depressed portion 84, the distance between the suction grill 82 and the heat-dissipating fan 5 may be increased as compared with a case where the cover body 81 does not have the depressed portion 84. This may ensure the required separation distance between the suction grill 82 and the heat-dissipation fan assembly 5, without increasing the length of the refrigerator's rear-front direction.

Figure 16:
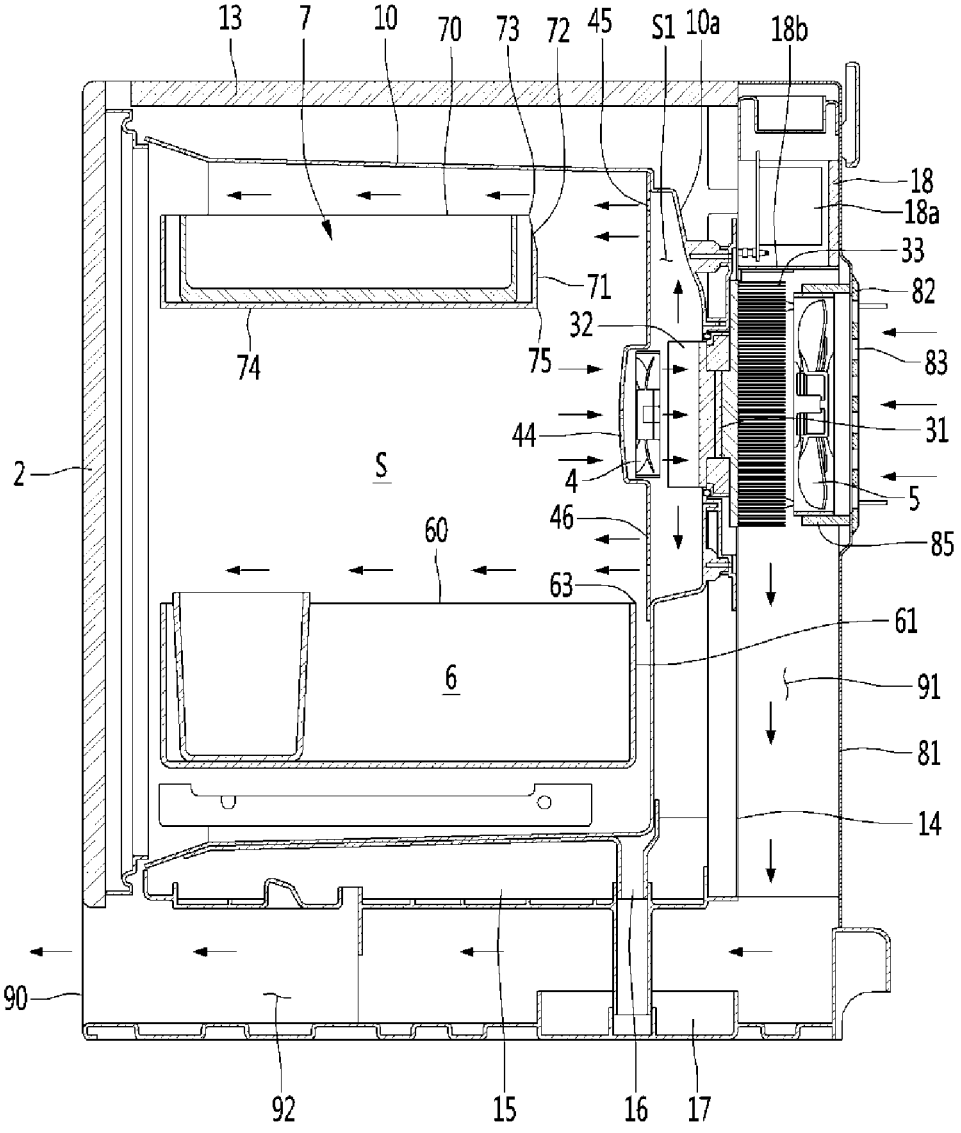
FIG. 16 is a cross section of the refrigerator according to an embodiment.

The heat-dissipation cover 8, together with the back plate 14, may define a rear dissipated-heat flow channel 91 (see FIG. 16). The rear dissipated-heat flow channel 91 may be located between the front face of the heat-dissipation cover 8 and the rear face of the back plate 14. The rear dissipated-heat flow channel 91 may be located between the front face of the cover body 81 and the rear face of the back plate 14.

During the operation of the heat-dissipation fan assembly 5, the air outside the refrigerator may be drawn into the heat-dissipation fan assembly 5 through the outer intake hole 83. The air sucked into the outer intake hole 83 may be heat-exchanged and heated in a heat sink 33. The heated air may then be directed to the rear dissipated-heat flow channel 91. This will be described in detail later.

The refrigerator may further include a blocking member (or gasket) 85 blocking the gap 86 (see FIG. 17) between the heat-dissipation fan assembly 5 and the heat-dissipation cover 8. The gasket 85 may have an annular shape. Preferably, the gasket 85 may have a rectangular ring shape. The gasket 85 may be formed by a combination of a plurality of members.

The gasket 85 may include a porous material. For example, the material of the gasket 85 may be EPDM: Ethylene propylene. Since the gasket 85 having a porous material is excellent in sound absorption and absorption performance, the gasket 85 may effectively reduce vibration and noise generated by driving the heat-dissipation fan.

The gasket 85 may contact the heat-dissipation cover 8. The gasket 85 may contact the front face of the heat-dissipation cover 8. The gasket 85 may also contact the inner circumference of the cover through-hole 81*a*.

The gasket 85 may contact the cover body 81 and/or the suction grill 82. When the gasket 85 contacts the cover body 81, the gasket 85 may contact the depressed portion 84.

The gasket 85 may block a gap 86 (see FIG. 17) between the heat-dissipation fan assembly 5 and the heat-dissipation cover 8. This may prevent the heated air from the heat sink 33 of the thermoelectric module 3 from flowing into the gap 86 between the heat-dissipation fan assembly 5 and the heat-dissipation cover 8 and being sucked into the heat-dissipation fan assembly 5.

The door 2 may open or close the storage chamber S. The door 2 may be coupled to the main body 1, and the coupling schemes and the number of the doors are not particularly limited. For example, the door 2 may be opened and closed via a hinge. The door may be a single one-way door or a plurality of bi-directional doors. Hereinafter, the door 2 will be exemplarily described as a drawer-type door that slides in a rear-front direction while being connected to the main body 1.

The door 2 may be joined to the front face of the main body 1. The door 2 may cover the open front face of the inner case 10, thereby opening and closing the storage chamber S. The door 2 may be formed of a wood material, but is not limited thereto.

A vertical direction height of the door 2 may be less than the height of the outer cabinet 12. A bottom portion of the door 2 may be spaced apart from the inner bottom face of the outer cabinet 12. Between the bottom of the door 2 and the bottom of the outer cabinet 12, a dissipated-heat flow channel outlet 90 in communication with a lower dissipated-heat flow channel 92 (see FIG. 16) may be defined.

The door 2 may be coupled with the main body 1 in a sliding manner. The door 2 may have a pair of slidable members (or slidable brackets) 20. The slidable brackets 20 may be slidably mounted on a pair of sliding rails 19 provided in the storage chamber S. Thus, the door 2 may be slid back and forth while facing the open front face of the inner case 10.

The sliding rails 19 may be respectively provided on the inner left side face and the inner right side face of the inner case 10. The sliding rail 19 may be provided at a position closer to the bottom face of the inner case than the top face of the inner case 10. The user may open the storage chamber S by pulling the door 1. The user may also close the storage chamber S by pushing in the door 2.

The refrigerator may include at least one storage member 6 and 7 disposed in the storage chamber S. The types of the storage members 6 and 7 are not limited specifically. For example, the storage members 6 and 7 may be shelves or drawers. Hereinafter, the case that the storage members 6 and 7 are drawers will be referred to.

Food may be placed or stored in the storage member 6 or 7. Each of the storage members 6 and 7 may be slidable in a rear-front direction. The left and right inner faces of the inner case 10 may include at least a pair of storage member rails corresponding to the storage members 6 and 7 respectively. Each of the storage members 6 and 7 may be slidably coupled to each of the storage member rails.

The storage members 6 and 7 may be configured to move with the door 2. For example, the storage members 6 and 7 may be detachably coupled to the door 2 via magnet. In this case, when the user pulls the door 2 and opens the storage chamber S, the storage members 6 and 7 may be moved forward along with the door 2.

Alternatively, the storage members 6 and 7 may move independently without moving with the door 2. The storage members 6 and 7 may be arranged horizontally in the storage chamber S. The top faces of the storage members 6 and 7 may be opened. Food may be stored in the inner spaces of the storage members 6 and 7.

The storage members 6 and 7 may include a first storage member 6 and a second storage member 7. The first storage member 6 may be located below the second storage member 7. The rear-front direction lengths of the first storage member 6 and the second storage member 7 may be the same or different. Further, the vertical direction heights of the first storage member 6 and the second storage member 7 may be the same or different.

The thermoelectric module 3 may cool the storage chamber S. The thermoelectric module 3 may use the Peltier effect to keep the temperature of the storage chamber S low. The thermoelectric module 3 may be arranged closer to a front of the refrigerator than the heat-dissipation cover 8.

Figure 6:
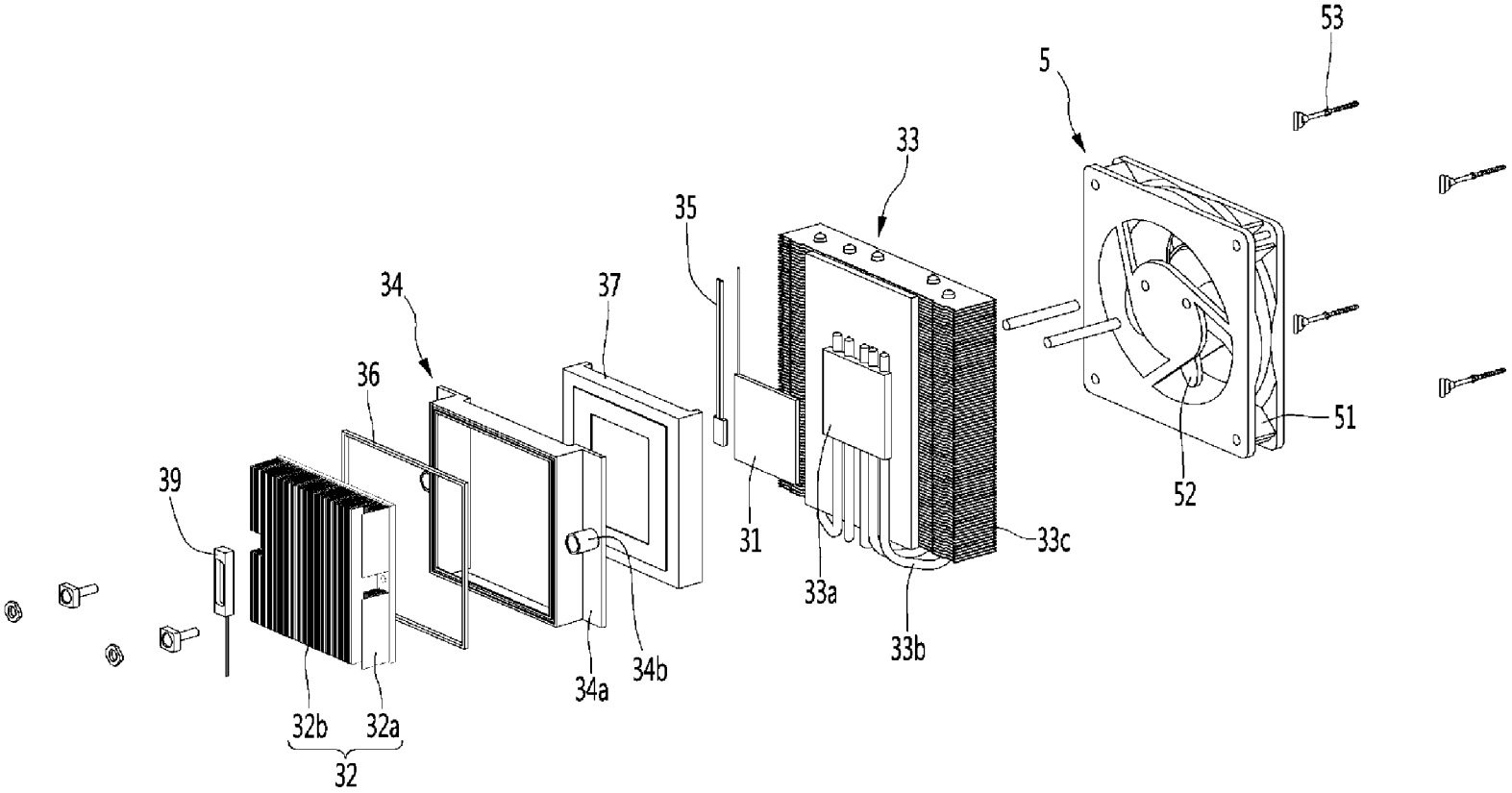
FIG. 6 is an exploded perspective view of the thermoelectric module and heat-dissipation fan shown in FIG. 5.
Figure 7:
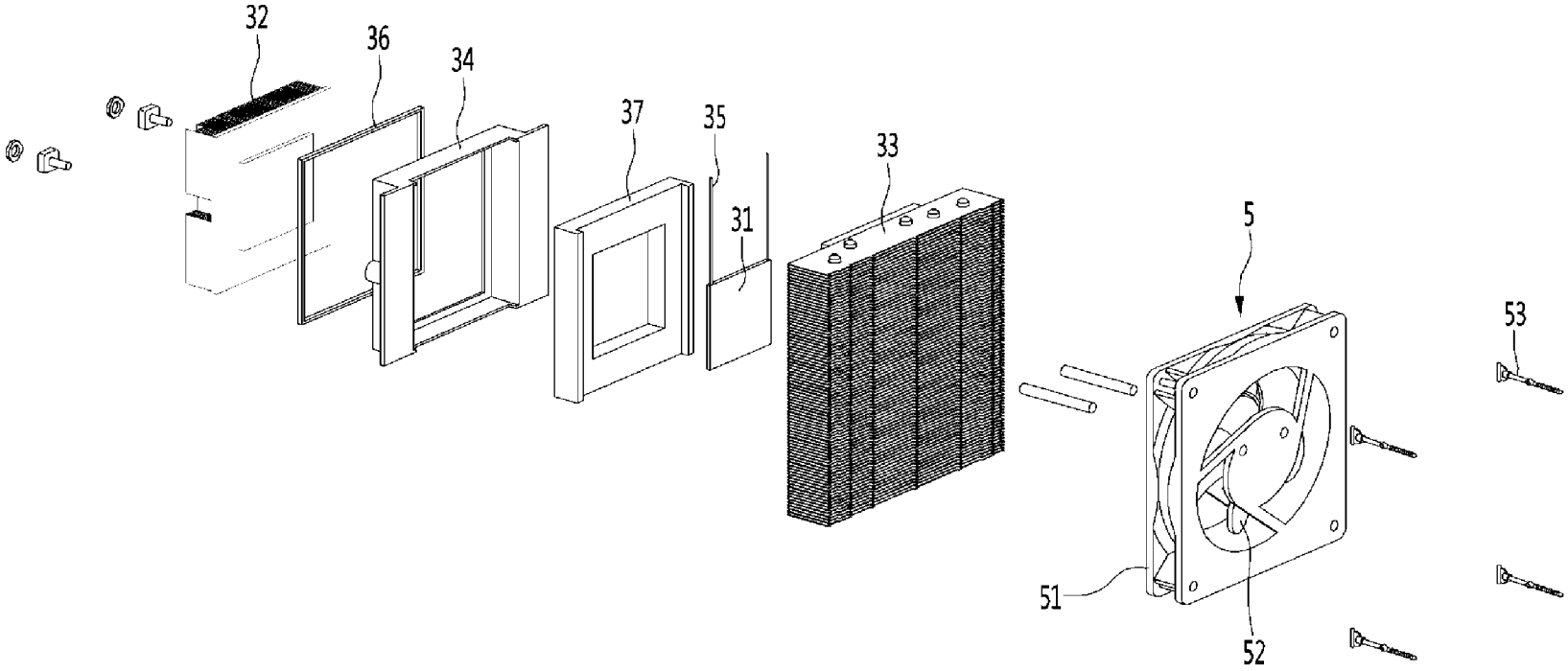
FIG. 7 is an exploded perspective view of the thermoelectric module and the heat-dissipation fan shown in FIG. 5, viewed in a different direction.
Figure 8:
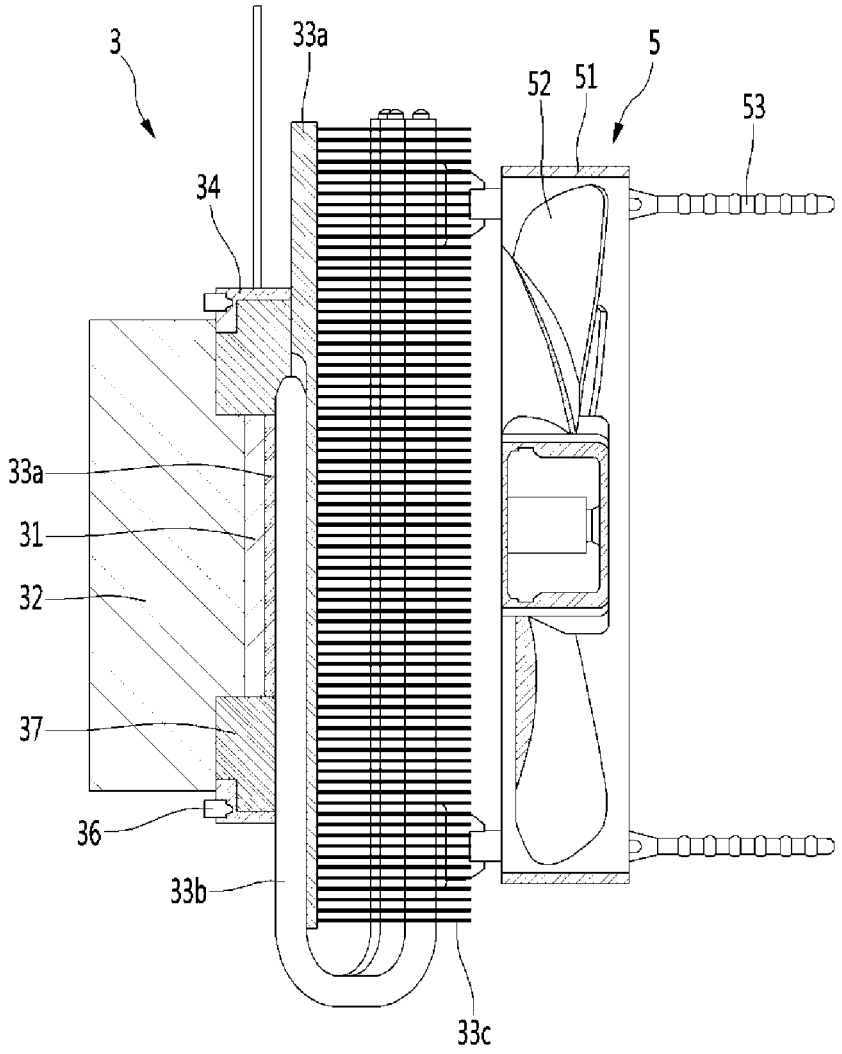
FIG. 8 is a cross-sectional view of the thermoelectric module and heat-dissipation fan according to an embodiment.
Figure 9:
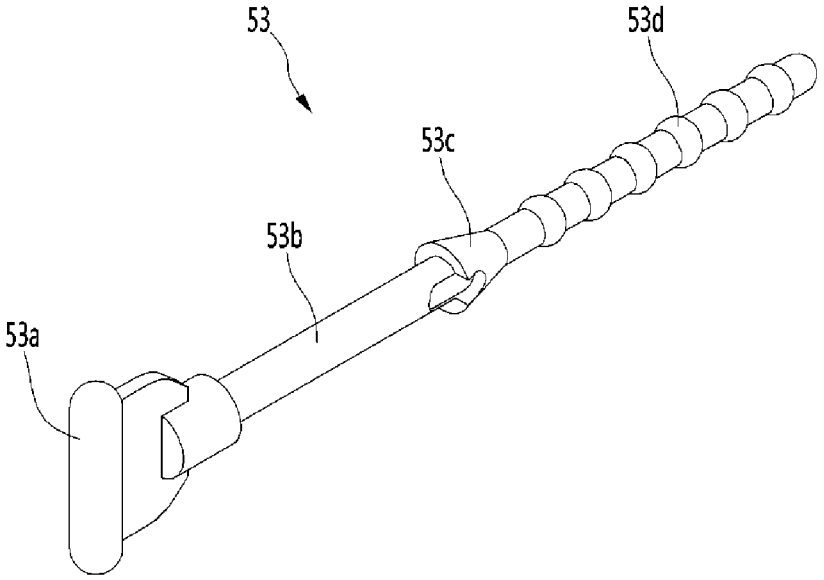
FIG. 9 is a perspective view of the fixing pin according to an embodiment.
Figure 10:
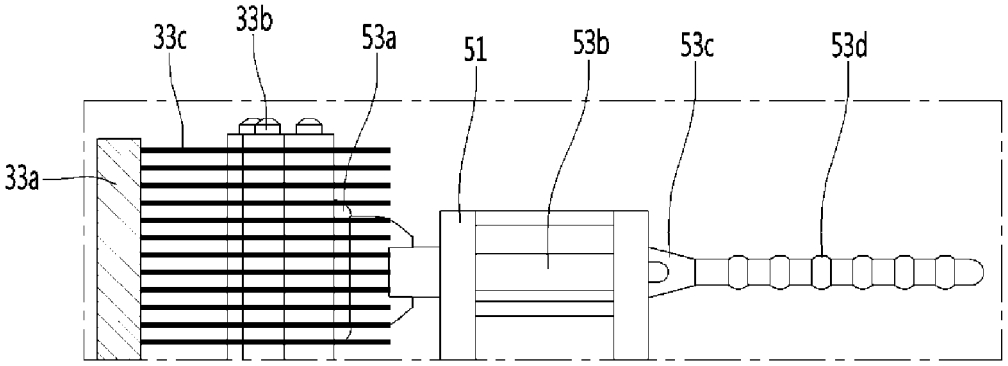
FIG. 10 is a side view illustrating the configuration in which the thermoelectric module and the heat-dissipation fan are fixed by the fixing pin.
Figure 11:
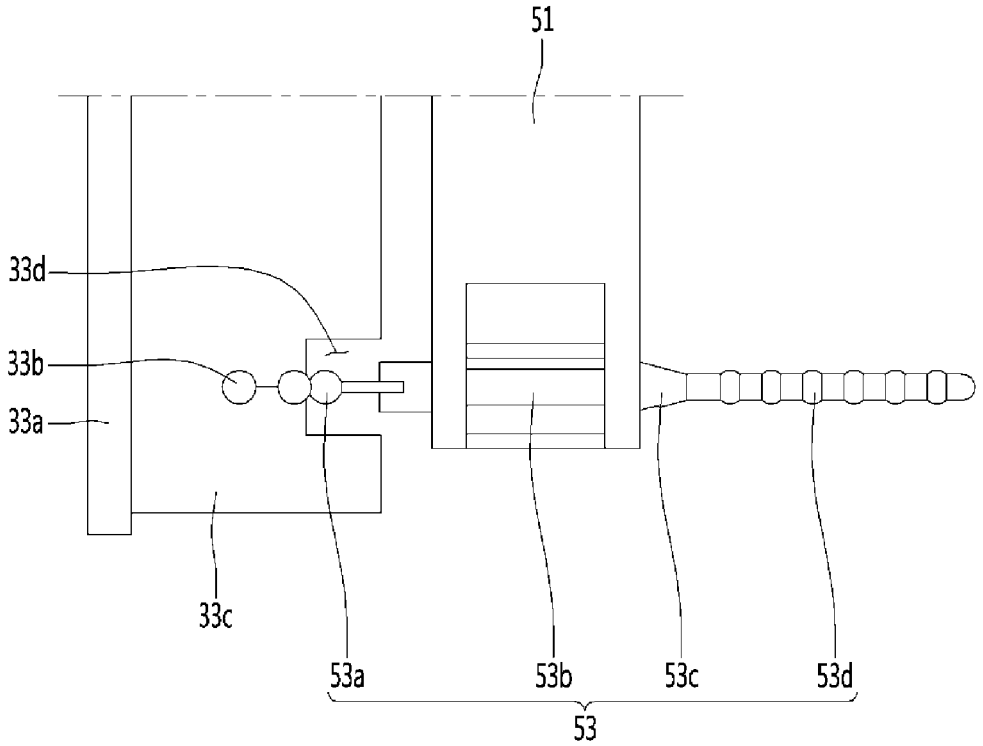
FIG. 11 is a top plan view illustrating the configuration in which the thermoelectric module and the heat-dissipation fan are fixed by the fixing pin.
Figure 12:
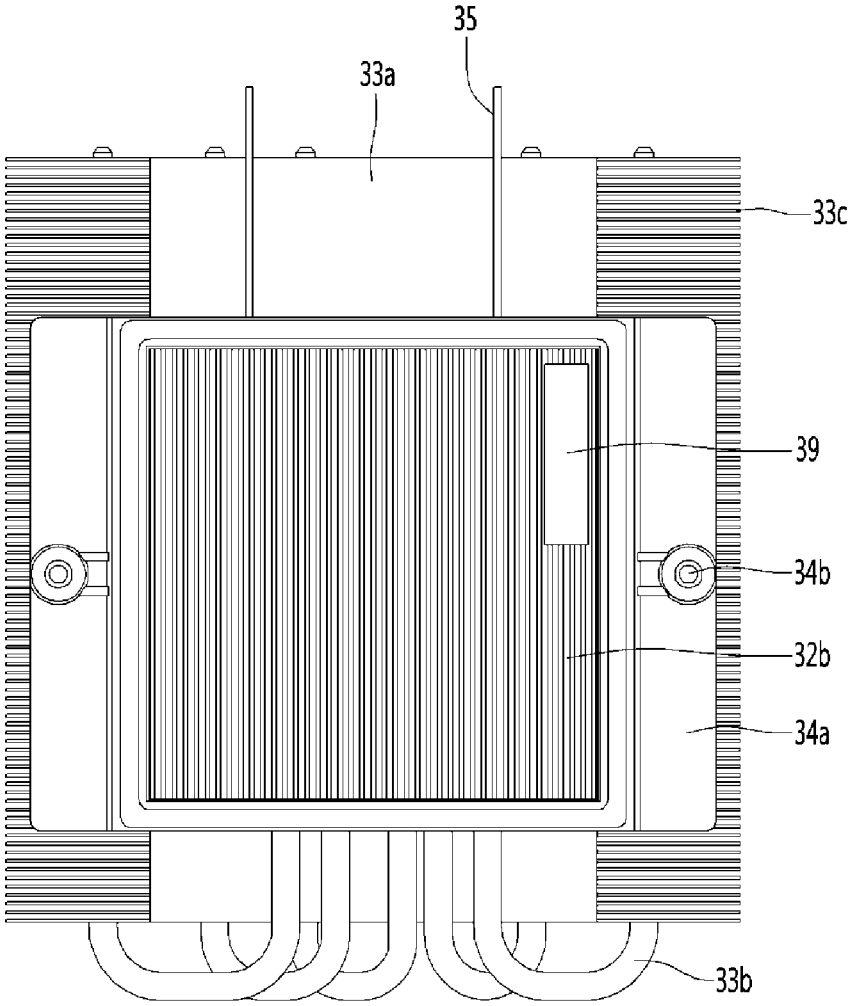
FIG. 12 is a front view of the thermoelectric module according to an embodiment.
Figure 13:
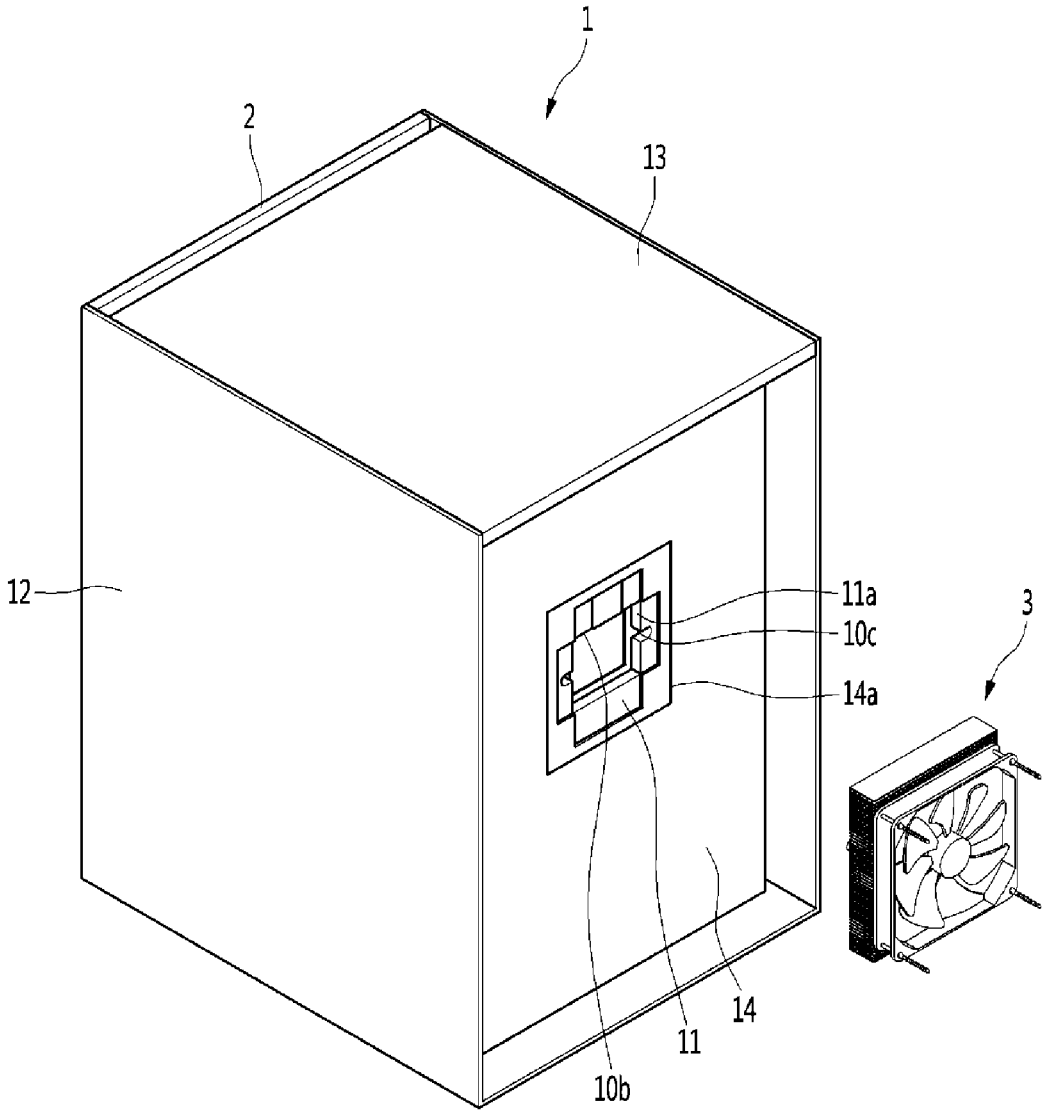
FIG. 13 is a diagram illustrating a configuration in which the thermoelectric module is mounted in the thermoelectric module holder, according to an embodiment.
Figure 14:
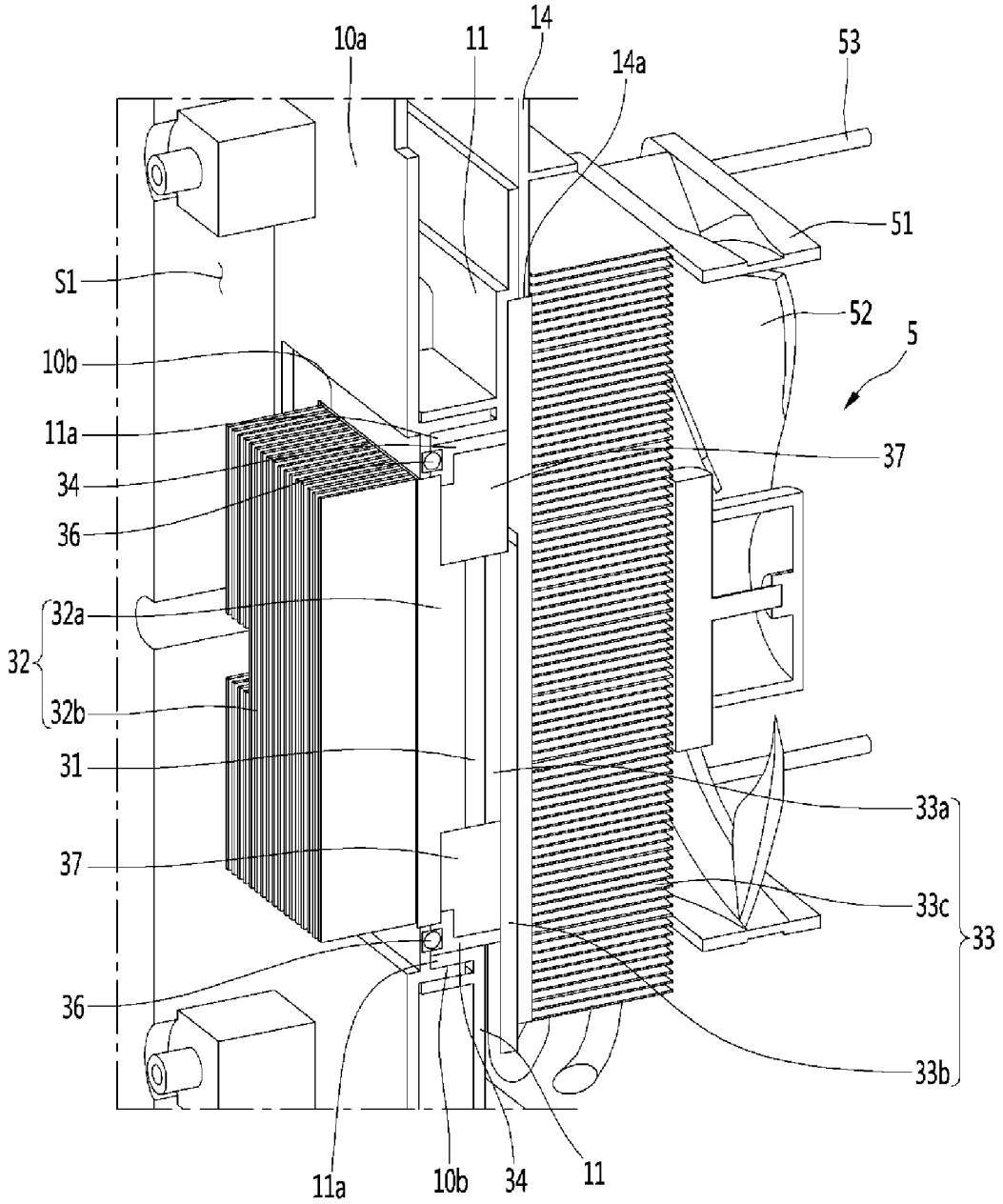
FIG. 14 is an exploded perspective view wherein the thermoelectric module is mounted on the inner case and the thermoelectric module holder, according to an embodiment.

The thermoelectric module 3 may include a thermoelectric element 31 (see FIG. 6), a cooling sink 32 (see FIG. 6), and a heat sink 33 (see FIG. 6). The thermoelectric element 31 may include a low-temperature sub-element and a high-temperature sub-element. The low-temperature sub-element and the high-temperature sub-element may be determined according to the direction of a voltage applied to the thermoelectric element 31. Further, depending on the voltage applied to the thermoelectric element 31, the temperature difference between the low-temperature sub-element and the high-temperature sub-element may be determined.

The thermoelectric element 31 may be arranged between the cooling sink 32 and the heat sink 33 and may contact the cooling sink 32 and the heat sink 33, respectively. The low-temperature sub-element of the thermoelectric element 31 may contact the cooling sink 32. The high-temperature sub-element of the thermoelectric element 31 may contact the heat sink 33. The detailed configuration of the thermoelectric module 3 will be described in detail later.

The refrigerator may further include a cooling fan assembly 4 to circulate air to the cooling sink 32 of the thermoelectric module 3 and the storage chamber S. The refrigerator may further include the heat-dissipation fan assembly 5 to circulate external air to the heat sink 33 of the thermoelectric module 3.

The cooling fan assembly 4 may be arranged in front of the thermoelectric module 3. The heat-dissipation fan assembly 5 may be arranged behind the thermoelectric module 3. The cooling fan assembly 4 may face the cooling sink 32 in the rear-front direction. The heat-dissipation fan assembly 5 may also face the heat sink 33 in the rear-front direction.

The cooling fan assembly 4 may be provided in the inner space of the inner case 10. The cooling fan assembly 4 may circulate air in the storage chamber S to the cooled-air flow channel S1 (see FIG. 16). The low temperature air which has heat-exchanged with the cooling sink 32 provided in the cooled-air flow channel S1 may again flow into the storage chamber S to lower the temperature in the storage chamber S.

The heat-dissipation fan assembly 5 may suck external air through the outer intake hole 83 defined in the heat-dissipation cover 8. More specifically, the heat-dissipation fan assembly 5 may draw in the outside air through the outer intake hole 83 defined in the suction grill 82.

The air sucked by the heat-dissipation fan assembly 5 may heat-exchange with the heat sink 33 located between the back plate 14 and the heat-dissipation cover 8. The heat exchanged air may then dissipate heat from the heat sink 33. The hot air which has heat-exchanged with the heat sink 33 may be guided to the rear dissipated-heat flow channel 91 (see FIG. 16) and the lower dissipated-heat flow channel 92 (see FIG. 16) in this order and may be released into the dissipated-heat flow channel outlet 90 located below the door 2.

The heat-dissipation fan assembly 5 may face the suction grill 82. The heat-dissipation fan assembly 5 may face the outer intake hole 83. The detailed configuration of the cooling fan assembly 4 and heat-dissipation fan assembly 5 will be described in detail later.

Hereinafter, the detailed configuration of the thermoelectric module 3, and the heat-dissipation fan assembly 5 will be described with reference to FIGS. 5 to 14. The thermoelectric module 3 may utilize the Peltier effect to keep the temperature of the storage chamber S low. The thermoelectric module 3 may include the thermoelectric element 31, the cooling sink 32, and the heat sink 33.

The thermoelectric element 31 may be provided between the cooling sink 32 and the heat sink 33 and may contact the cooling sink 32 and the heat sink 33, respectively. The low-temperature sub-element of the thermoelectric element 31 may contact the cooling sink 32, while the high-temperature sub-element of the thermoelectric element 32 may contact the heat sink 33.

The thermoelectric element 31 may have a fuse 35. When an overvoltage is applied to the thermoelectric element, the fuse 35 may cut off the voltage applied to the thermoelectric element 31. The cooling sink 32 may be a cooling heat-exchanger connected to the low-temperature sub-element of the thermoelectric element 31. The cooling sink 32 may cool the storage chamber S.

Further, the heat sink 33 may be a heating heat-exchanger connected to the high-temperature sub-element of the thermoelectric element 31. The heat sink 33 may heat-dissipate the heat absorbed by the cooling sink 32.

The thermoelectric module 3 may be positioned closer to the front of the refrigerator than the heat-dissipation cover 8. The distance between the cooling sink 32 and the inner case 10 may be less than the distance between the heat sink 33 and the inner case 10. The cooling sink 32 may be located in front of the thermoelectric element 31. The cooling sink 32 may be kept at a low temperature in contact with the low-temperature sub-element of the thermoelectric element 31.

Further, the distance between the heat sink 33 and the heat-dissipation cover 8 may be less than the distance between the cooling sink 32 and the heat-dissipation cover 8.

The heat sink 33 may be maintained at a high temperature in contact with the high-temperature sub-element of the thermoelectric element 31. The heat sink 33 may be arranged below the controller 18*a* to be described later.

The thermoelectric module 3 may be configured such that any one of the thermoelectric element 31, the cooling sink 32, and the heat sink 33 is passed through the hole 14*a* defined therein. The thermoelectric module 3 may be configured so that the heat sink 33 passes through the through-hole 14*a*. In this case, the thermoelectric element 31 and the cooling sink 32 may be positioned in front of the through-hole 14*a*, while the heat sink 33 may be partially located behind the through-hole 14*a*.

The cooling sink 32 may include a cooling plate 32*a* and a cooling fin structure 32*b*. The cooling plate 32*a* may contact the thermoelectric element 31. A portion of the cooling plate 32*a* may be inserted into a thermoelectric element accommodation hole defined in a thermal insulation member 37 and may be in contact with the thermoelectric element 31. The cooling plate 32*a* may be positioned between the cooling fin structure 32*b* and the thermoelectric element 31. The cooling plate 32*a* may contact the low-temperature sub-element of the thermoelectric element 31 to transfer the heat of the cooling fin structure 32*b* to the low-temperature sub-element of the thermoelectric element 31.

The cooling plate 32*a* may be formed of a material having a high thermal conductivity. The cooling plate 32*a* may be located in the thermoelectric module mounting hole 10*b* of the inner case 10. The cooling sink 32 may block the thermoelectric module mounting hole 10*b* of the inner case 10. Preferably, the cooling plate 32*a* may block the thermoelectric module mounting hole 10*b* of the inner case 10.

The cooling fin structure 32*b* may contact the cooling plate 32*a*. The cooling fin structure 32*b* may protrude from the cooling plate 32*a*. The cooling fin structure 32*b* may be located in front of the cooling plate 32*a*. At least a portion of the cooling fin structure 32*b* may be located within the cooled-air flow channel S1 defined in the thermoelectric module mount 10*a*. Thus, the at least a portion of the cooling fin structure 32*b* may be heat-exchanged with air in the cooled-air flow channel S1 to cool the air therein.

The cooling fin structure 32*b* may have a plurality of fins to increase the heat exchange area with air. The cooling fin structure 32*b* may be formed to guide the air in a vertical direction. Each of the plurality of fins constituting the cooling fin structure 32*b* may be embodied as a vertical plate having a left side and a right side and extending in a vertical direction.

The cooling fin structure 32*b* may be arranged between the fan 42 of the cooling fan assembly 4 and the thermoelectric element 31. The cooling fin structure 32*b* may guide the air blown from the fan 42 of the cooling fan assembly 4 to the upper ejection hole 45 and a lower ejection hole 46. The air blown from the fan 42 of the cooling fan assembly 4 may be dispersed up and down by the cooling fin structure 32*b*.

The heat sink 33 may include a heat-dissipation plate 33*a*, a heat-dissipation pipe 33*b*, and a heat-dissipation fin structure 33*c*. The heat dissipation plate 33*a* may contact the thermoelectric element 31. A portion of the heat-dissipation plate 33*a* may be inserted into a thermoelectric element mounting hole formed in the thermal insulating member 37 to contact the thermoelectric element 31. The heat-dissipation plate 33*a* may contact the high-temperature sub-element of the thermoelectric element 31 to conduct heat to the heat-dissipation pipe 33*b* and the heat-dissipation fin structure 33*c*.

The heat dissipation plate 33*a* may be formed of a material having a high thermal conductivity. At least one of the heat-dissipation plate 33*a* and the heat-dissipation fin structure 33*c* may be arranged in the through-hole 14*a* of the back plate 14.

The heat-dissipation pipe 33*b* may be implemented as a heat pipe accommodating a thermoelectric fluid therein. A first portion of the heat-dissipation pipe 33*b* may penetrate the heat-dissipation plate 33*a*, while a second portion of the pipe 33 may pass through the heat-dissipation fin structure 33*c*.

In the first portion of the heat-dissipation pipe 33*b* contacting the heat-dissipation plate 33*a*, the thermoelectric fluid contained in the heat-dissipation pipe 33*b* may be evaporated, while in the second portion of the heat-dissipation pipe 33*b* contacting the heat-dissipation fin structure 33*c*, the thermoelectric fluid contained therein may be condensed. The thermoelectric fluid may circulate in the heat-dissipation pipe 33*b* via density difference and/or gravity, such that the heat of the heat-dissipation plate 33*a* may be conducted to the heat-dissipation fin structure 33*c*.

The heat-dissipation fin structure 33*c* may contact at least one of the heat-dissipation plate 33*a* and the heat-dissipation pipe 33*b*. The heat-dissipation fin structure 33*c* may be spaced apart from the heat-dissipation plate 33*a* and may be connected to the heat-dissipation plate 33*a* through the heat-dissipation pipe 33*b*. When the heat-dissipation fin structure 33*a* is in contact with the heat-dissipation plate 33*a*, the heat-dissipation pipe 33*b* may be omitted.

The heat-dissipation fin structure 33*c* may include a plurality of fins vertically arranged on the heat-dissipation pipe 33*b*. The heat-dissipation fin structure 33*c* may guide the air blown from the heat-dissipation fan assembly 5. The air guiding direction by the heat-dissipating fin 33*c* may be different from the air guiding direction by the cooling fin structure 32*b*. For example, when the cooling fin structure 32*b* guides air in the vertical direction, the heat-dissipation fin structure 33*c* may guide the air in a horizontal direction.

The heat-dissipating fin 33*c* may to guide the air in the horizontal direction, particularly, in the left-right direction among the rear-front direction and the left-right direction. Each of the plurality of fins constituting the heat-dissipation fin structure 33*c* may include a horizontal plate having a top face and a bottom face and extending in the horizontal direction.

When the heat-dissipation fin structure 33*c* is elongated in the vertical direction, there may be a large amount of air guided by the heat-dissipation fin structure 33*c* toward the controller 18*a*. Conversely, when the heat-dissipation fin structure 33*c* is elongated in the horizontal direction as described above, air flowing toward the controller 18*a* as guided by the heat-dissipation fin structure 33*c* may be minimized.

The heat-dissipation plate 33*a* may be located between the heat-dissipation fin structure 33*c* and the thermoelectric element 31. The heat-dissipation fin structure 33*c* may be located behind the heat-dissipation plate 33*a*.

The heat-dissipation fin structure 33*c* may be located behind the back plate 14. The heat-dissipation fin structure 33*c* may be positioned between the back plate 14 and the heat-dissipation cover 8. Thus, the heat-dissipation fin structure 33*c* may be heat-dissipated by heat exchange with the external air sucked by the heat dissipation fan assembly 5.

The thermoelectric module 3 may further include a module frame 34 and the thermal insulation member 37. The module frame 34 may be box-shaped. The module frame 34 may have a space therein to accommodate the thermal insulating member 37 and the thermoelectric element 31. The module frame 34 and the thermal insulating member 37 may protect the thermoelectric element 31.

The module frame 34 may be formed of a material that minimizes heat loss due to heat conduction. For example, the module frame 34 may be made of a non-metallic material such as plastic, for example. The module frame 34 may prevent heat from the heat sink 33 from being conducted to the cooling sink 32.

A gasket 36 may be provided on the front face of the module frame 34. The gasket 36 may be made of an elastic material such as rubber. The gasket 36 may be formed in a rectangular ring shape, but the present disclosure is not limited thereto. The gasket 36 may be a sealing member.

The gasket 36 may be located on the rear face of the thermoelectric module mount 10*a* and/or on the circumference of the thermoelectric module mounting hole 10*b*. The gasket 36 may be located between the module frame 34 and the thermoelectric module mount 10*a* and may be compressed in the rear-front direction.

The gasket 36 may prevent cold air in the cooled-air flow channel S1 defined in the thermoelectric module mount 10*a* from leaking into the gap between the thermoelectric module mounting hole 11*b* and the cooling sink 32.

The module frame 34 may include an extension 34*a*. The extension 34*a* may extend outwardly from an at least portion of the periphery of the module frame 34. The extension 34*a* may extend outwardly from the left and right sides of the module frame 34, respectively.

A boss 34*b* may be fixed onto the extension 34*a*. A thread may be formed in the boss 34*b*. A fastener such as a bolt may be fastened to the thread. The fastener may be coupled to the extension 34*a* of the module frame 34 through a fastener hole 10*c* formed in the inner case 10 inside the inner case 10. More particularly, the fastener may be coupled to the boss 34*b* on the extension 34*a*. As a result, the thermoelectric module 3 and the inner case 10 may be firmly fastened such that it is possible to prevent the cold air in the inner case 10 from leaking to the outside.

The thermal insulating member 37 may surround the outer circumference of the thermoelectric element 31. The thermal insulating member 37 may enclose the top face, left face, bottom face, and right face of the thermoelectric element 31. The thermoelectric element 31 may be located within the thermal insulating member 37. The thermal insulating member 37 may include a thermoelectric element receiving hole defined therein and opened in the rear-front direction. The thermoelectric element 31 may be located within the thermoelectric element receiving hole.

The thickness of the rear-front direction of the thermal insulation member 37 may be larger than the thickness of the thermoelectric element 31. The thermal insulating member 37 may prevent heat from being conducted to an outer periphery of the thermoelectric element 31, thereby increasing the efficiency of the thermoelectric element 31. That is, the circumference of the thermoelectric element 31 may be surrounded by the thermal insulating member 37, such that heat generated from the heat sink 33 may transfer to the cooling sink 32 at a minimum level.

The thermal insulating member 37 and the thermoelectric element 31 may be arranged in the inner space of the module frame 34 and may be protected by the module frame 34. The module frame 34 may surround the outer perimeter of the thermal insulating member 37.

The refrigerator may further include a thermoelectric module holder 11 (see FIG. 3) configured to fix the thermoelectric module 3 to the inner case 10 and/or back plate 14. The thermoelectric module holder 11 may couple the thermoelectric module 3 to the inner case 10 and/or back plate 14. The thermoelectric module holder 11 may be coupled to the thermoelectric module mount 10*a* and/or back plate 14 of the inner case 10 via a fastener such as a screw.

The thermoelectric module holder 11, together with the thermoelectric module 3, may block the through-hole 14*a* of the back plate 14. The thermoelectric module holder 11 may include a hollowed portion 11*a*. The hollowed portion 11*a* may be formed by protruding a portion of the thermoelectric module holder 11 forward. The module frame 34 may be inserted and fitted into the hollowed portion 11*a*. The hollowed portion 11*a* may wrap around the module frame 34.

The front portion of the thermoelectric module 3 may be located in front of the through-hole 14*a* of the back plate 14, while the rear portion of the thermoelectric module 3 may be located behind the through-hole 14*a* of the back plate 14. The thermoelectric module 3 may further include a sensor 39. The sensor 39 may be attached to the cooling sink 32. The sensor 39 may be a temperature sensor or a defrost sensor.

The heat-dissipation fan assembly 5 may be located behind the thermoelectric module 3. The heat-dissipation fan assembly 5 may face the heat sink 33 at a rear of the heat sink 33. The heat-dissipation fan assembly 5 may blow external air into the heat sink 33.

The heat-dissipation fan assembly 5 may face the suction grill 82. The heat-dissipation fan assembly 5 may face the outer intake hole 83. The heat-dissipation fan assembly 5 may include a fan 52 and a shroud 51 that surrounds the fan 52. The fan 52 of the heat-dissipation fan assembly 5 may be an axial fan.

The heat-dissipation fan assembly 5 may be separated from the heat sink 33. Thus, the flow resistance of the air blown by the heat-dissipation fan assembly 5 may be minimized, and the heat exchange efficiency in the heat sink 33 may be increased.

The heat-dissipation fan assembly 5 may include at least one fixing pin 53. The fixing pin 53 may contact the heat sink 33. The fixing pin 53 may separate the heat-dissipation fan assembly 5 from the heat sink 33 and, at the same time, fix the heat-dissipation fan assembly 5 to the heat sink 33.

The fixing pin 53 may be formed of a material having a low thermal conductivity such as rubber or silicone. The fixing pin 53 may include a head 53*a*, a pin body 53*b*, a fixing portion 53*c*, and an extension 53*d*. The head 53*a* may contact the heat sink 33. The head 53*a* may contact the heat-dissipation pipe 33*b* and/or the heat-dissipation fin 33*c* of the heat sink 33.

The heat-dissipation fin 33*c* may have a groove 33*d* defined in a portion at which the heat pipe 33*b* is located. The head 53*a* of the fixing pin 53 may be inserted into the groove 33*d* of the heat-dissipation fin 33*c*. More specifically, the grooves 33*d* formed in the plurality of heat-dissipation fins 33*c* may form a long space formed in a vertical direction. The head 53*a*, which is long in a vertical direction may be inserted into the long space.

The head 53*a* may have a larger diameter than the pin body 53*b*. The pin body 53*b* may be disposed in the heat-dissipation fan assembly 5. The pin body 53*b* may be disposed in a fixing-pin through-hole formed in the shroud 51.

The rear-front direction length of the pin body 53*b* may be equal to the rear-front direction thickness of the heat-dissipation fan assembly 5. The pin body 53*b* may be positioned between the head 53*a* and the fixing portion 53*c*.

At least a portion of the diameter of the fixing portion 53*c* may be larger than the diameter of the pin body 53*b*. After the fixing pin 53 is inserted through the shroud 51 of the heat-dissipating fan assembly 5, the fixing portion 53*c* may press against the shroud 51. The fixing portion 53*c* may be fixed to the shroud 51 while being in contact with the rear face of the shroud 51.

The extension 53*d* may extend rearward from the fixing portion 53*c*. The diameter of the extension 53*d* may be smaller than or equal to that of the fixing portion 53*c*. A screw thread or the like may be formed around the outer periphery of the extension 53*d*. The extension 53*d* may be coupled with the heat-dissipation cover 8 or pass may through the heat-dissipation cover 8.

The heat-dissipation fan assembly 5 may suck external air through the outer intake hole 83 defined in the suction grill 82 of the heat-dissipation cover 8. The air sucked by the heat-dissipation fan assembly 5 may heat-exchange with the heat sink 33 located between the back plate 14 and the heat-dissipation cover 8, thereby dissipating heat from the heat sink 33.

Figure 15:
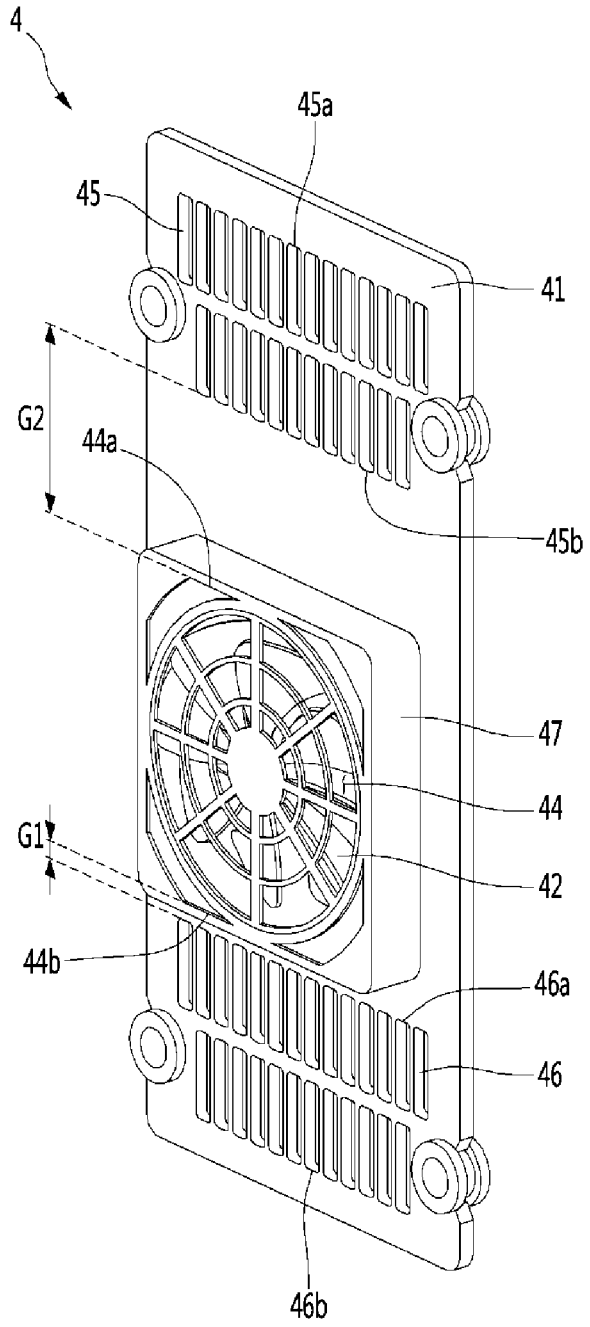
FIG. 15 is a perspective view of a cooling fan assembly according to an embodiment.

The cooling fan assembly 4 will be described in detail with reference to FIG. 15 below. The cooling fan assembly 4 may be arranged in front of the thermoelectric module 3 and may face the cooling sink 32.

The cooling fan assembly 4 may circulate the air to the cooled-air flow channel S1 and the storage chamber S. Forced convection may be generated between the cooled-air flow channel S1 and the storage chamber S by the cooling fan assembly 4. The cooling fan assembly 4 may distribute the air in the storage chamber S to the cooled-air flow channel S1. Then, the hot air which has heat-exchanged with the cooling sink 32 in the cooled-air flow channel S1 may then flow back to the storage chamber S to keep the temperature in the storage chamber S low.

The cooling fan assembly 4 may include a fan cover 41 and a fan 42. The fan cover 41 may be provided in the inner space of the inner case 10. The fan cover 41 may be arranged vertically. The fan cover 41 may partition the storage chamber S and the cooled-air flow channel S1. The storage chamber S may be located in front of the fan cover 41. The cooled-air flow channel S1 may be located at the rear of the fan cover 41.

The fan cover 41 may have an inner intake hole 44 and inner ejection holes 45 and 46 defined therein. The number, size and shape of the inner intake hole 44 and inner ejection holes 45 and 46 may vary as needed. The inner ejection holes 45 and 46 may include the upper ejection hole 45 and the lower ejection hole 46. The upper ejection hole 45 may be formed above the inner intake hole 44, while the lower ejection hole 46 may be formed below the inner intake hole 44. With this configuration, the temperature distribution of the storage chamber S may be uniform.

In this connection, each of the upper ejection hole 45 and the lower ejection hole 46 may mean a through-hole group including a plurality of through-holes. Similarly, the inner intake hole 44 may also mean a through-hole group including a plurality of through-holes.

The area of the upper ejection hole 45 and the area of the lower ejection hole 46 may be the same. That is, the sum of the areas of the plurality of through-holes constituting the upper ejection hole 45 may be equal to the sum of the areas of the plurality of through-holes constituting the lower ejection hole 46.

The distance G1 between the top 46*a* of the lower ejection hole 46 and the bottom 44*b* of the inner intake hole 44 may be smaller than the distance G2 between the bottom 45*b* of the upper ejection hole 45 and the top 44*a* of the inner intake hole 44. That is, the inner intake hole 44 may be formed closer to the lower ejection hole 46 than to the upper ejection hole 45.

The area of the inner intake hole 44 may vary depending on the size of the fan 41. The area of the inner ejection hole 45 and 46 may be at a predetermined ratio with respect to the area of the inner intake hole 44.

The area of the inner ejection holes 45 and 46 may be larger than the area of the inner intake hole 44. That is, the sum of the areas of the plurality of through-holes constituting the inner ejection holes 45 and 46 may be greater than the sum of the areas of the plurality of through-holes constituting the inner intake hole 44. The area of the inner ejection holes 45 and 46 may be between 1.3 times or more and 1.5 times or less of the area of the inner intake hole 44.

The fan cover 41 may include a fan accommodation portion or shroud 47. The fan accommodation portion 47 may be formed by projecting the front face of the fan cover 41 forward. A fan accommodation space may be formed in the fan accommodation portion 47. At least a portion of the fan 42 may be located within the fan accommodation space defined within the fan accommodation portion 47. The inner intake hole 44 may be defined in the fan accommodation portion 47.

The fan 42 may be located within the cooled-air flow channel S1. The fan cover 41 may cover the fan in front of the fan 42. The fan 42 may face the cooling sink 32. The fan 42 may be located between the inner intake hole 44 and the cooling sink 32.

The fan 42 may face the inner intake hole 44. When the fan 42 is driven, the air in the storage chamber S may be sucked into the cooled-air flow channel S1 through the inner intake hole 44, and may be heat-exchanged with the cooling sink 32 of the thermoelectric module 3, thereby cooling the air. Then, the cooled air may be ejected through the inner ejection holes 45 and 46 into the storage chamber S. Thereby, the temperature of the storage chamber S may be kept low. More specifically, a portion of the air cooled from the cooling sink 32 may be directed upward and ejected through the upper ejection hole 45 to the storage chamber S, while another portion of the air-cooled may be directed downward and ejected into the storage chamber S through the lower ejection hole 46.

Figure 17:
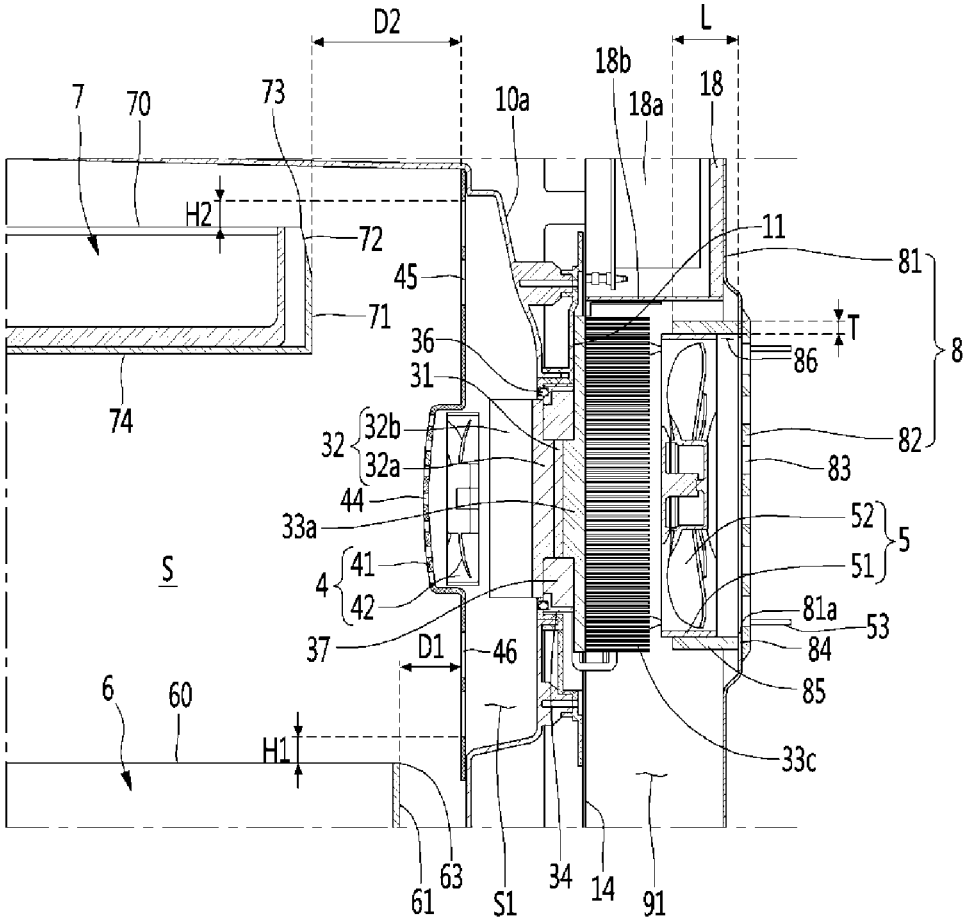
FIG. 17 is an enlarged cross-sectional view of a peripheral portion of the thermoelectric module of the refrigerator shown in FIG. 16.
Figure 18:
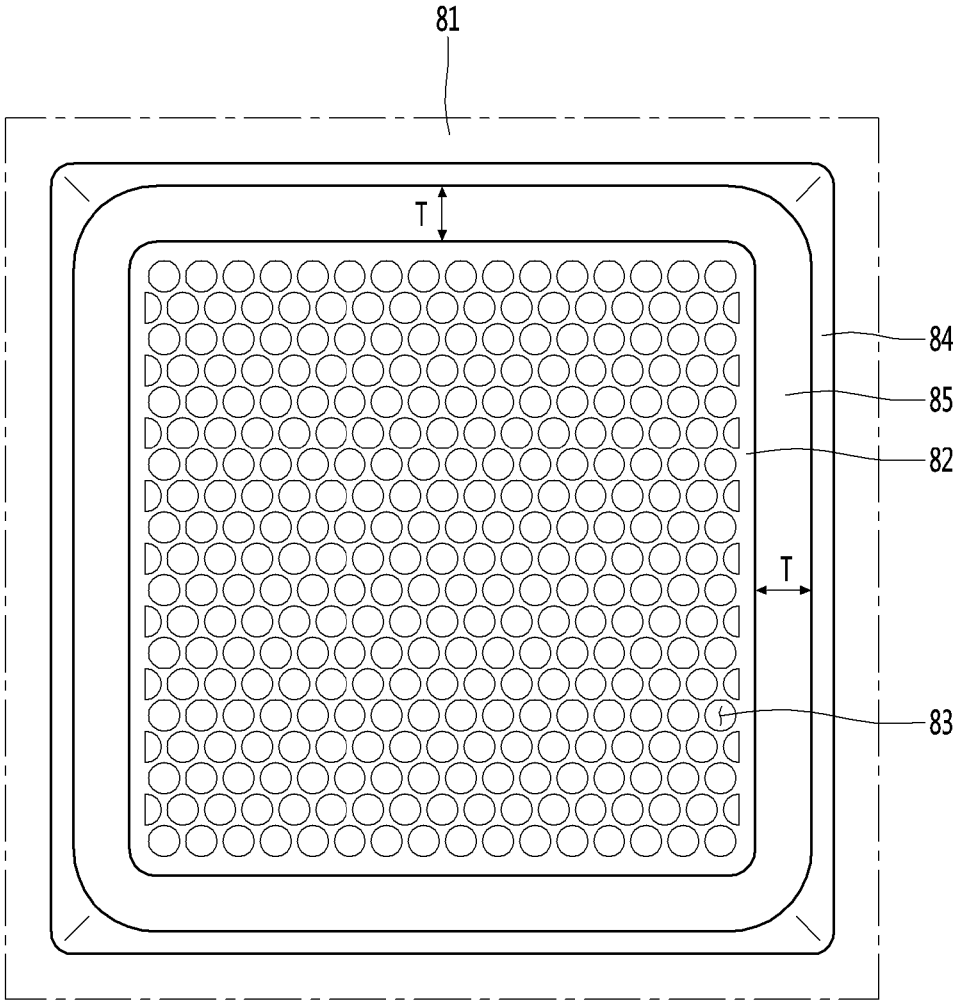
FIG. 18 is a front view of a heat-dissipation cover according to an embodiment.

FIG. 16 is a cross section of the refrigerator according to an embodiment of the present disclosure. FIG. 17 is an enlarged cross-sectional view of an outer portion of the thermoelectric module of the refrigerator shown in FIG. 16. FIG. 18 is a front view of a heat-dissipation cover according to an embodiment of the present disclosure.

Referring to FIGS. 16 to 18, at least a portion of each of the inner intake hole 44 and the lower ejection hole 46 may be directed toward a space between the first storage member 6 and the second storage member 7. Further, at least a portion of the upper ejection hole 45 may be directed toward a space between the top face of the storage chamber 10 and the second storage member 7.

The lower portion 46*b* of the lower ejection hole 46 may be located at the rear and upper position of the first storage member 6. More specifically, the lower portion 46*b* of the lower ejection hole 46 may be located at the rear and upper position of the rear top portion 63 of the first storage member 6.

A rear face 61 of the first storage member 6 may face the lower portion of the lower ejection hole 46 in the horizontal direction. The lower ejection hole 46 may not overlap with the first storage member 6 in the horizontal direction. That is, the first storage member 6 may not screen the lower ejection hole 46 in the horizontal direction.

Thus, the flow of the low-temperature air ejected to the lower ejection hole 46 may not be disturbed by the first storage member 6, so that air circulation in the storage chamber S may be smooth. Further, the cold air may be lowered to keep the food stored in the first storage member 6 at a low temperature.

The lower ejection hole 46 and the first storage member 6 may be spaced apart from each other to further facilitate air circulation within the storage chamber S. The lower portion 46*b* of the lower ejection hole 46 and the first storage member 6 may be spaced apart from each other by a first horizontal spacing D1 in the horizontal direction, while the lower portion 46*b* of the lower ejection hole 46 and the first storage member 6 may be spaced apart from each other by a first vertical spacing H1 in the vertical direction.

More specifically, the first horizontal spacing D1 may refer to a horizontal distance between an extension extending vertically upwards from the rear face 61 of the first storage member 6 and the lower ejection hole 46. The first vertical spacing H1 may mean the vertical distance between an extension extending horizontally forward from the lower portion 46*b* of the lower ejection hole 46 and a top 60 of the first storage member 6.

The first horizontal spacing D1 may refer to the spacing between the rear face of the storage chamber S and the first storage member. In this instance, the rear face of the storage chamber S may be the front face of the fan cover 41. The first vertical spacing H1 may refer to the height difference between the lower portion 46*b* of the lower ejection hole 46 and the top 60 of the first storage member 6.

A portion of the upper ejection hole 45 may overlap with the second storage member 7 in the horizontal direction. More specifically, the upper portion of the upper ejection hole 45 may be directed toward space between the top 70 of the second storage member 7 and the top face of the storage chamber S, while the lower portion of the upper ejection hole 45 may face the rear face 71 of the second storage member 7. The upper portion 45*a* of the upper ejection hole 45 may be located at the rear upper position of the rear top 73 of the second storage member 7.

According to this embodiment, the height of the storage chamber S may be lowered and the refrigerator may be compact, compared to the case where the upper ejection hole 45 does not overlap with the second storage member 7 in the horizontal direction. In addition, as described above, the inner intake hole 44 of the fan cover 41 may be formed closer to the lower ejection hole 46 of the cover 41 than to the upper ejection hole 45 of the cover 41. Thus, the height of the storage chamber S may be further lowered to satisfy the positional relationship between the storage member 6 and 7 and the inner intake hole 44 and the inner ejection hole 45 and 46 as described above.

At least a portion of the rear face 71 of the second storage member 7 may be inclined upward. A portion of the rear face 71 of the second storage member 7 facing the upper ejection hole 45 may be an inclined face 72 inclined upward. The lower portion of the upper ejection hole 45 may face the inclined face 72.

The inclined face 72 may guide the low temperature air ejected from the upper ejection hole 45 to the top of the second storage member 7. As a result, the food stored in the second storage member 7 may be kept at a low temperature.

The upper ejection hole 45 and the second storage member 7 may be spaced apart from each other to further facilitate air circulation within the storage chamber S. The upper portion 45*a* of the upper ejection hole 45 and the second storage member 7 may be spaced apart from each other by the second horizontal spacing D2 in the horizontal direction, and, at the same time, the upper portion 45*a* of the upper ejection hole 45 and the second storage member 7 may be spaced apart from each other by the second vertical spacing H2 in the vertical direction.

More specifically, the second horizontal spacing D2 may mean the horizontal distance between the rear face 71 of the second storage member 7 and the upper ejection hole 45. The second vertical spacing H2 may mean a vertical distance between an extension extending horizontally forward from the upper portion 45*a* of the upper ejection hole 45 and a top 70 of the second storage member 7.

The second horizontal spacing D2 may mean a spacing between the rear face of the storage chamber S and the second storage member 7. With this arrangement, the rear face of the storage chamber S may be the front face of the fan cover 41. The second vertical spacing H2 may refer to the height difference between the upper portion 45*a* of the upper ejection hole 45 and top 60 of the second storage member 7.

The second horizontal spacing D2 between the rear face 71 of the second storage member 7 and the upper ejection hole 45 may be greater than the first horizontal spacing D1 between the rear face 61 of the first storage member 6 and the lower ejection hole 46. Unlike the first storage member 6, the second storage member 7 may face the portion of the upper ejection hole 45 in the horizontal direction, requiring additional spacing for air circulation within the storage chamber S. Thus, the rear-front direction length of the first storage member 6 may be longer than the rear-front direction length of the second storage member 7.

The inner intake hole 44 may face a space between the first storage member 6 and the second storage member 7. The inner intake hole 44 may not overlap the second storage member 7 in the horizontal direction. Thereby, air flow to the inner intake hole 44 may be smooth and the temperature of the storage chamber S may be lowered to improve the refrigerating performance of the refrigerator.

The vertical direction height of the second storage member 7 may be smaller than the vertical direction height of the first storage member 6. Due to such a configuration, a food container having a larger height such as a bottle or the like may be housed in the first storage member 6, while the second storage member 7 may contain a food container with a relatively smaller height.

The refrigerator may have the dissipated-heat flow channel 91 and 92 and the cooled-air flow channel S1 defined therein. The cooling sink 32 may be located in the cooled-air flow channel S1, while the heat sink 33 may be located within the dissipated-heat flow channels 91 and 92. The cooled-air flow channel S1 may communicate with the storage chamber S, while the dissipated-heat flow channels 91 and 92 may communicate with the outside of the main body 1.

The air in the storage chamber S may be guided into the cooled-air flow channel S1 by driving the cooling fan assembly 4 and then may be heat-exchanged with the cooling sink 32 and then may be cooled. The cooled-air flow channel S1 may be located in the inner space of the inner case 10. The cooled-air flow channel S1 may be located in the inner space of the thermoelectric module mount 10*a*. The cooled-air flow channel S1 may be defined by a rear face of the fan cover 41 and an inner face of the thermoelectric module mount 10*a*.

The cooled-air flow channel S1 may communicate with the inner intake hole 44 and the inner ejection holes 45 and 46. The cooling sink 32 may be arranged to face the fan 42. The cooled-air flow channel S1 may guide air sucked into the inner intake hole 44 to the inner ejection holes 45 and 46. The outside air may be guided to the dissipated-heat flow channels 91 and 92 by driving the heat-dissipation fan assembly 5, and then may be heat-exchanged with the heat sink 33 and may be heated.

The dissipated-heat flow channels 91 and 92 may be located outside the inner case 10. The dissipated-heat flow channels 91 and 92 may include the rear dissipated-heat flow channel 91 located at the rear of the inner case 10 and the lower dissipated-heat flow channel 92 located at a lower side of the inner case 10. The rear dissipated-heat flow channel 91 may be located between the back plate 14 and the heat-dissipation cover 8. The rear dissipated-heat flow channel 91 may be defined by the rear face of the back plate 14 and the inner face of the heat-dissipation cover 8.

The heat sink 33 may be located in the rear dissipated-heat flow channel 91. The heat sink 33 may face the heat-dissipation fan assembly 5. At least a portion of the rear dissipated-heat flow channel 91 may act as a machine room.

The rear dissipated-heat flow channel 91 may communicate with the outer intake hole 83. The rear dissipated-heat flow channel 91 may direct the air drawn into the outer intake hole 83 by the heat-dissipation fan assembly 5 to the lower dissipated-heat flow channel 92.

The lower dissipated-heat flow channel 92 may be located between the cabinet bottom 15 and the outer cabinet 12. The lower dissipated-heat flow channel 92 may communicate with the rear dissipated-heat flow channel 91. The lower dissipated-heat flow channel 92 may direct air flowing from the rear dissipated-heat flow channel 91 to the dissipated-heat flow channel outlet 90 below the door 2.

The PCB cover 18 may cover the controller 18*a*. The controller 18*a* may include electronic components such as a PCB substrate. The controller 18*a* may receive and store the measured values from each sensor provided in the refrigerator. The controller 18*a* may also control the thermoelectric module 3, the cooling fan assembly 4, and the heat-dissipation fan assembly 5. The controller 18*a* may further control additional components as needed.

The controller 18*a* may be located above the heat sink 33 and/or heat-dissipation fan assembly 5. A barrier 18*b* may be provided between the heat sink 33 and/or the heat-dissipation fan assembly 5 and the controller 18*a*. That is, the barrier 18*b* may be located below the controller 18*a*. The barrier 18*b* may prevent the controller 18*a* from overheating by heat emitted from the heat sink 33. Further, the barrier 18*b* may prevent heated air from the heat sink 33 from flowing to the controller 18*a*.

The barrier 18*b* may be mounted on the heat-dissipation cover 8 and/or back plate 14. Alternatively, the barrier 18*b* may be mounted on the PCB cover 18 or integrally formed with the PCB cover 18. The PCB cover 18 may be located above or in front of the heat dissipation cover 8. The PCB cover 18 may cover the rear and/or top portion of the controller 18*a*.

The PCB cover 18 may be located below the top cover 13 and behind the inner case 10. Further, the PCB cover 18 may be located above the heat sink 33 and/or heat-dissipation fan assembly 5 of the thermoelectric module 3 as described below. For example, when the top of the heat-dissipation cover 8 is spaced apart from the top cover 13, the PCB cover 18 may cover the rear of the controller 18*a*. Thus, it may be possible to prevent the controller 18*a* from being exposed to the rear of the main body 1.

When the top of the heat-dissipation cover 8 contacts the top cover 13, the controller 18*a* may not be exposed to the rear of the main body 1 by the heat-dissipation cover 8. Thus, the PCB cover 18 may cover the top side of the controller 18*a*, and may not cover the rear side of the controller 18*a*.

The blocking member 85 may block the gap 86 between the heat-dissipation fan assembly 5 and the heat-dissipation cover 8. More specifically, the blocking member 85 may block the gap 86 between the shroud 51 of the heat-dissipation fan assembly 5 and the heat-dissipation cover 8.

If the gap 86 between the heat-dissipation fan assembly 5 and the heat-dissipation cover 8 is not blocked by the blocking member 85, the air sucked into the heat-dissipation fan assembly 5 through the outer intake hole 83 may be blown to the heat sink 33 and heated by the heat sink 33. Thereby, a portion of the air heated by the heat sink 33 may flow into the gap 86 between the shroud 51 and the heat-dissipation cover 8 and may be re-sucked into the heat-dissipation fan assembly 5, resulting in flow disturbance. This flow disturbance may produce noise of a tone having a low frequency range. Further, the already heated air may be blown back to the heat sink 33 and, thus, the heat dissipation efficiency of the heat sink 33 may be lowered.

The blocking member 85 may prevent the air heated by the heat sink 33 from flowing into the gap 86 between the heat-dissipation fan assembly 5 and the heat-dissipation cover 8 so that the air may be prevented from being sucked into the heat-dissipating fan assembly 5. That is, the re-circulation phenomenon of the heated air may be prevented. Thereby, the noise generated by the flow disturbance may be reduced, and the heat-dissipation efficiency of the heat sink 33 may be increased.

Further, as described above, the blocking member 85 may be made of a porous material. As a result, the blocking member 85 may effectively reduce the vibration and noise generated in the driving of the heat-dissipation fan assembly 5 itself.

The blocking member 85 may contact each of the heat-dissipation fan assembly 5 and the heat-dissipation cover 8. The blocking member 85 may surround the outer periphery of the heat-dissipation fan assembly 5. More specifically, the blocking member 85 may be surround the outer circumference of the shroud 51. The blocking member 85 may also touch the shroud 51. The blocking member 85 may contact the heat-dissipation cover 8 and may contact the front face of the cover 8.

The blocking member 85 may contact the cover body 81 and/or the suction grill 82. When the blocking member 85 contacts the cover body 81, the blocking member 85 may contact the depressed portion 84.

The rear-front direction length L of the blocking member 85 may be longer than its thickness T. The length L of the blocking member 85 in the rear-front direction may be between 15 mm and 20 mm, while the thickness T of the blocking member 85 may be between 5 mm and 10 mm.

Figure 19:
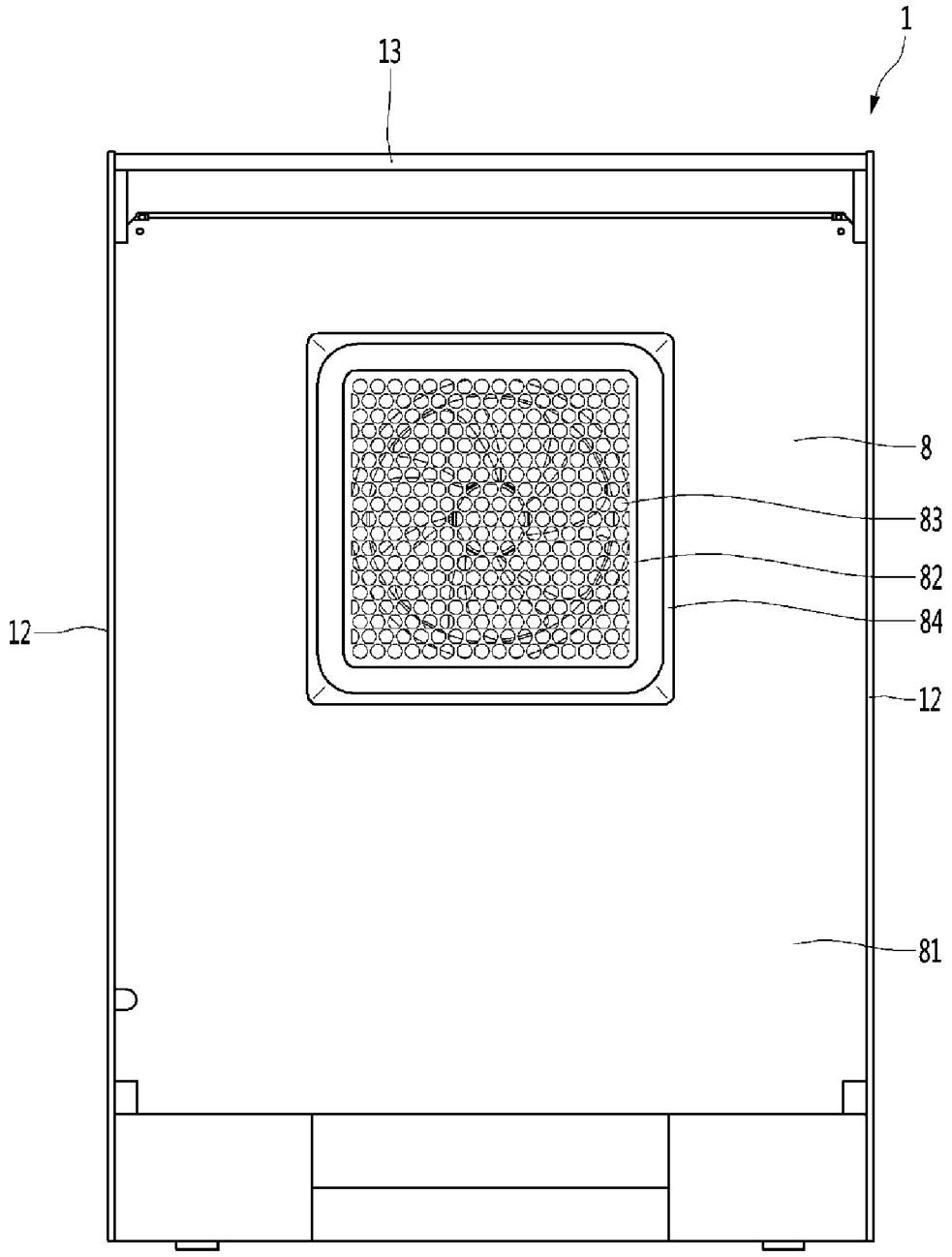
FIG. 19 is a rear view of the refrigerator according to an embodiment.
Figure 20:
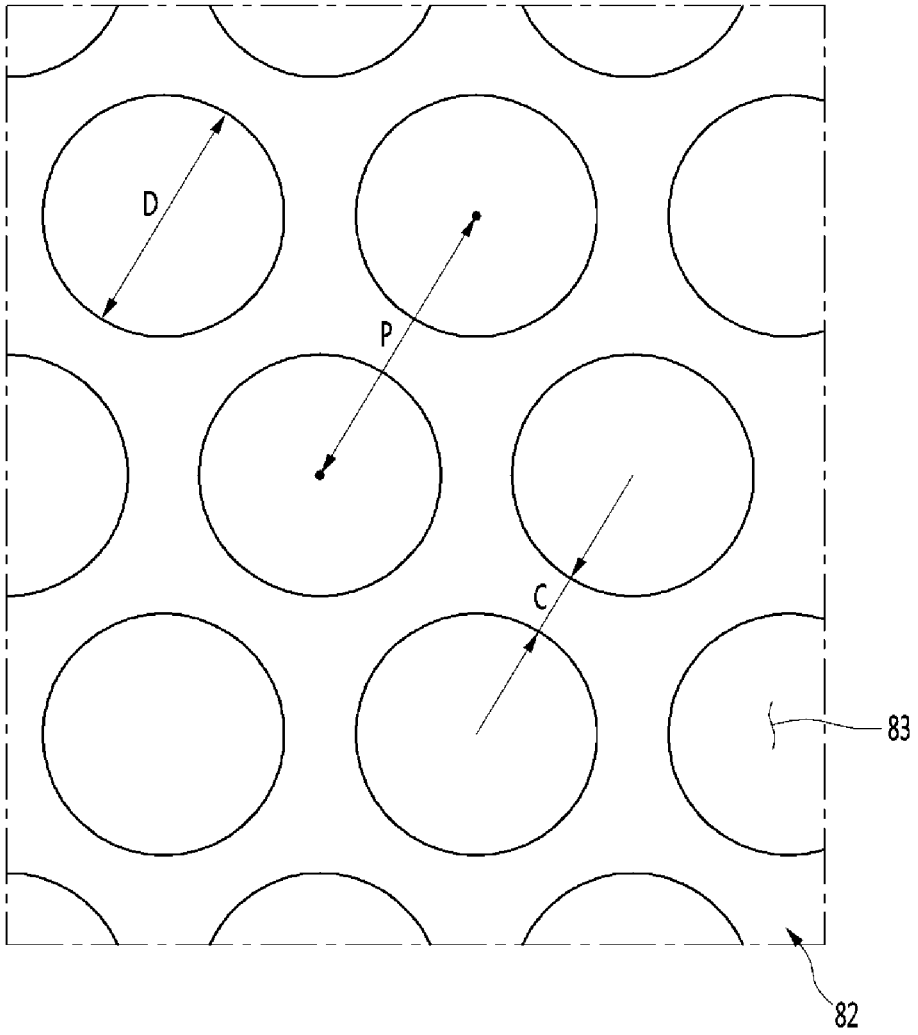
FIG. 20 is an enlarged view of a portion of the suction grill shown in FIG. 19.

FIG. 19 shows the rear view of the refrigerator according to an embodiment of the present disclosure. FIG. 20 shows an enlarged view of the portion of the suction grill shown in FIG. 19. Referring to FIGS. 19 and 20, the outer intake hole 83 defined in the heat-dissipation cover 8 may have a plurality of perforations.

A plurality of the outer intake holes 83 may be formed in the suction grill 82. Each of the outer intake holes 83 may be formed in a circular shape.

Table 1 is a table that measures the noise of the refrigerator according to one embodiment.

TABLE 1

| Heat-dissipation cover condition | Measurement position | Cooling fan and heat-dissipation fan conditions: low speed | middle speed | high speed |
|---|---|---|---|---|
| Absence of suction grill 82, presence of blocking member 85 | front | 17.9 | 19.1 | 19.9 |
| | rear | 19.1 | 20.7 | 21.6 |
| Suction grill 82 with D = 8 mm, C = 1 mm, presence of blocking member 85 | front | 18.1 | 19.2 | 20.2 |
| | rear | 18.8 | 21.1 | 21.9 |
| Suction grill 82 with D = 8 mm C = 1.5 mm, presence of blocking member 85 | front | 18.4 | 19.7 | 20.5 |
| | rear | 20.2 | 22.1 | 23.2 |
| Suction grill 82 with D = 7 mm, C = 1 mm, presence of blocking member 85 | front | 18.5 | 19.8 | 20.7 |
| | rear | 20.7 | 21.5 | 23.5 |
| Suction grill 82 with D = 7 mm, C = 1.5 mm, presence of blocking member 85 | front | 18.8 | 20.5 | 21.3 |
| | rear | 20.6 | 21.9 | 23.8 |

The unit of noise shown in Table 1 is dBA. With regard to the noise measurement position, the measurement noise may be measured at a position 1*m* away from the refrigerator in a front direction and at a position 1*m* away in the rear direction. Further, with respect to the condition of the cooling fan assembly 4 and the heat-dissipation fan assembly 5, the cooling fan assembly 4 may be rotated at 851 rpm and the heat-dissipation fan assembly 5 may be driven at 1807 rpm in a low speed condition. In the middle speed condition, the cooling fan assembly 4 may be driven at 922 rpm and the heat-dissipation fan assembly 5 may be driven at 1903 rpm. In the high speed condition, the cooling fan assembly 4 may be driven at 947 rpm and the heat-dissipation fan assembly 5 may be driven at 2001 rpm. Further, the length L of the blocking member 85 in the rear-front direction may be 20 mm, while the thickness T of the blocking member 85 may be 10 mm.

If the refrigerator does not include the suction grill 82, the noise may be the smallest. However, the suction grill 82 may be mounted for the safety of the user. Even when the suction grill 82 is mounted, the noise may not increase sharply as compared with the case where the suction grill 82 is not included.

Referring to Table 1, the measured noise may vary depending on the diameter D of the outer intake hole 83 defined in the suction grill 82 and the spacing distance C between the outer intake holes 83. However, when the diameter D of the outer intake hole 83 is 7 mm or 8 mm, and the spacing distance C between the outer intake holes 83 is 1 mm or 1.5 mm, the noise measurement may not be significantly different from the case where the suction grill 82 is not included.

Therefore, the diameter D of the outer intake hole 83 may be between about 7 mm and about 8 mm. The spacing C between the adjacent outer intake holes 83 may be between about 1 mm and about 1.5 mm. The spacing distance P between the centers of the pair of adjacent outer intake holes 83 among the plurality of the outer intake holes 83 may be between about 7 mm and about 10 mm. The diameter D of the outer intake hole 83 may be 8 mm, while the distance C between a pair of neighboring outer intake holes 83 may be 1 mm.

Figure 21:
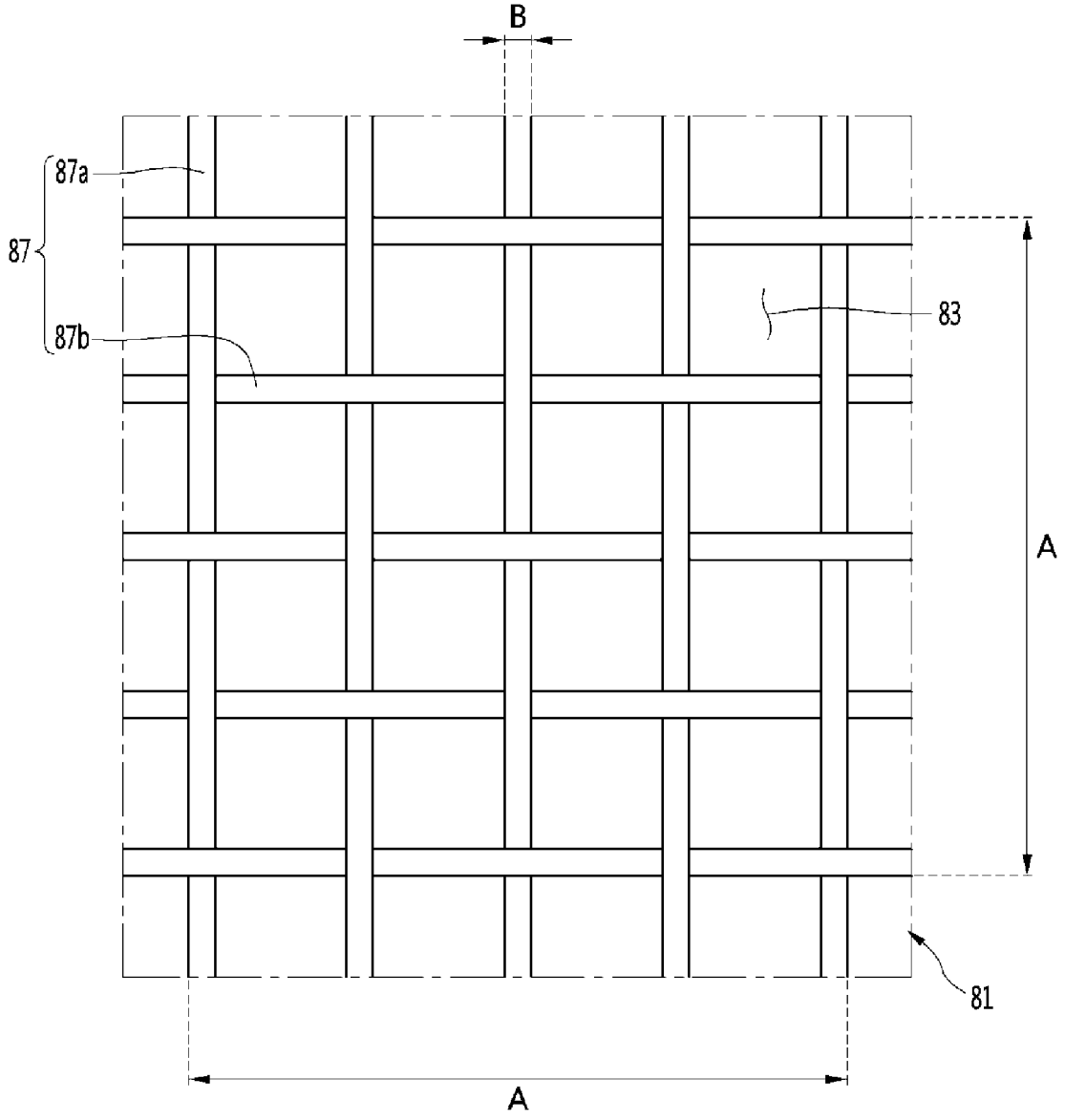
FIG. 21 is an enlarged view of a portion of a suction grill according to another embodiment of the present disclosure.

FIG. 21 is an enlarged view of a portion of the suction grill according to another embodiment of the present disclosure. The refrigerator according to this embodiment is identical to the refrigerator according to the embodiments described above except for the suction grill 82. Therefore, the description of the overlapping components will be omitted below, and the differences will be mainly described.

The suction grill 82 may be implemented as a mesh consisting of a plurality of wires 87. The suction grill 82 may have a rectangular shaped outer intake hole 83 defined between the wires 87.

The wires 87 may include a first wire 87*a* and a second wire 87*b*. The first wire 87*a* and the second wire 87*b* may be arranged to intersect one another. Any one of the outer intake holes 83 may be defined by a pair of first wires 87*a* adjacent to each other and a pair of second wires 87*b* adjacent to each other. The first wire 87*a* and the second wire 87*b* may be orthogonal to each other. The outer intake hole 83 may have a square shape.

Table 2 is a table for measuring the noise of the refrigerator according to another embodiment.

TABLE 2

| Heat-dissipation cover condition | Measurement position | Cooling fan assembly and heat-dissipation fan condition: low speed | middle speed | high speed |
|---|---|---|---|---|
| Absence of suction grill 82, presence of blocking member 85 | front | 17.9 | 19.1 | 19.9 |
| | rear | 19.1 | 20.7 | 21.6 |
| Suction grill with 82B = 1 mm, presence of blocking member 85 | front | 18.5 | 19.5 | 20.6 |
| | rear | 20.1 | 21.7 | 22.8 |
| Suction grill 82 with B = 1.6 mm, presence of blocking member 85 | front | 18.5 | 19.6 | 20.1 |
| | rear | 20.4 | 21.2 | 22.2 |

The unit of noise shown in Table 2 is dBA. With regard to the noise measurement position, the measurement noise may be measured at a position 1*m* away from the refrigerator in a front direction and at a position 1*m* away in the rear direction. Further, with respect to the condition of the cooling fan assembly 4 and the heat-dissipation fan assembly 5, the cooling fan assembly 4 may be rotated at 851 rpm and the heat-dissipation fan assembly 5 may be driven at 1807 rpm in a low speed condition. In the middle speed condition, the cooling fan assembly 4 may be driven at 922 rpm and the heat-dissipation fan assembly 5 may be driven at 1903 rpm. In the high speed condition, the cooling fan assembly 4 may be driven at 947 rpm and the heat-dissipation fan assembly 5 may be driven at 2001 rpm. Further, the length L of the blocking member 85 in the rear-front direction may be 20 mm, while the thickness T of the blocking member 85 may be 10 mm.

Further, the suction grill 82 may have 16 the outer intake holes 83 of four rows and four columns. The sixteen outer intake holes 83, consisting of four rows and four columns, are defined in a virtual square A having a length of a longitudinal side 1 inch and a transverse side 1 inch.

Referring to Table 2, the measurement noise may be changed by varying the thickness B of the wire 87 constituting the suction grill 82. However, when the thickness B of the wire 87 is 1 mm or 1.6 mm, the measurement noise may not be significantly different from the case where the suction grill 82 is not included. Therefore, the thickness B of the wire 87 may be between about 1 mm and about 1.6 mm. In this arrangement, the suction grill 82 may have 16 of the outer intake holes 83 of four rows and four columns. The sixteen outer intake holes 83, consisting of four rows and four columns, are defined in a virtual square A having a length of a longitudinal side 1 inch and a transverse side 1 inch.

Figure 22:
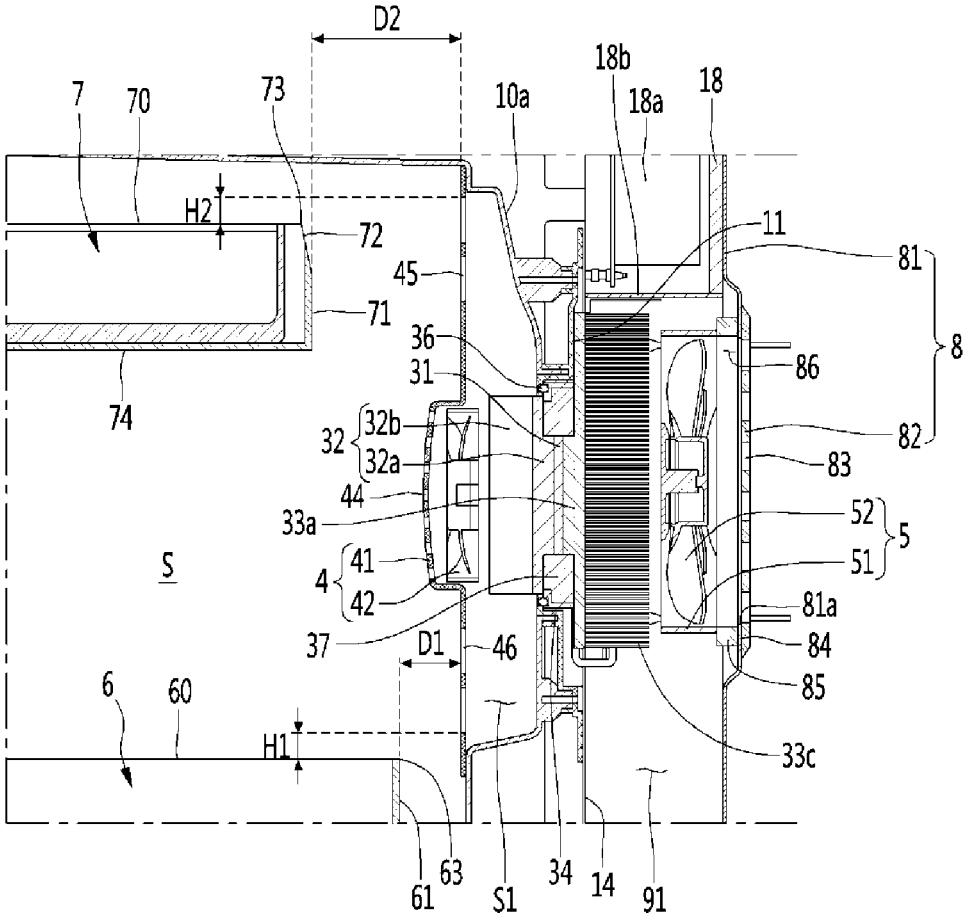
FIG. 22 is a partial cross-sectional view of the refrigerator according to another embodiment of the present disclosure.

FIG. 22 is an enlarged view of a portion of the suction grill according to another embodiment of the present disclosure. The refrigerator according to this embodiment is identical to the refrigerator according to the embodiments described above except for the blocking member 85. Therefore, the description of the overlapping components will be omitted below, and the differences will be mainly described.

The blocking member 85 may be arranged between the heat-dissipation cover 8 and the heat-dissipation fan assembly 5. More specifically, the blocking member 85 may be located between the shroud 51 of the heat-dissipation fan assembly 5 and the heat-dissipation cover 8.

The blocking member 85 may contact each of the heat-dissipation fan assembly 5 and the heat-dissipation cover 8. More specifically, the blocking member 85 may contact the rear face of the shroud 51, while the blocking member 85 may contact the front face of the heat-dissipation cover 8.

According to this embodiment, since the blocking member 85 is located between the heat-dissipation fan assembly 5 and the heat-dissipation cover 8, the blocking member may prevent the gap 86 between the heat-dissipation fan assembly 5 and the heat-dissipation cover 8 more directly. Further, since the blocking member 85 may be squeezed in the rear-front direction by each of the heat-dissipation fan assembly 5 and the heat-dissipation cover 8, the gap between the blocking member 85 and the heat-dissipation fan assembly 5 and the gap between the blocking member 85 and the heat-dissipation cover 8, respectively, may effectively be sealed. As such, the blocking member 85 may more effectively prevent flow disturbances.

Further, the blocking member 85 may be made of a porous material. In this case, the vibration caused by the driving of the heat-dissipation fan assembly 5 may be absorbed by the blocking member 85 to prevent the vibration of the heat-dissipation cover 8.

According to an embodiment of the present disclosure, the blocking member may block the gap between the heat-dissipation fan and the heat-dissipation cover to prevent flow disturbance due to air recirculation, so that the heat-dissipation efficiency of the heat sink may be increased. Further, the blocking member may reduce the noise and vibration caused by the operation of the heat-dissipation fan. Further, the size and shape of the outer intake hole through which the outside air is sucked may be limited, thereby preventing the user's finger from touching the heat-dissipation fan, and reducing the generation of noise due to the suction of the outside air.

A refrigerator may comprise an inner case having a storage chamber defined therein; a thermoelectric module configured to cool the storage chamber, wherein the thermoelectric module includes a thermoelectric element and a heat sink; a heat-dissipation fan assembly facing the heat sink; a heat-dissipation cover spaced apart from the inner case, wherein the heat-dissipation cover has at least one outer intake hole defined therein, wherein the intake hole faces the heat-dissipation fan assembly; and a blocking member configured to block a gap between the heat-dissipation cover and the heat-dissipation fan assembly. In one implementation of the first aspect, the blocking member may surround an outer periphery of the heat-dissipation fan assembly.

The heat-dissipation fan assembly may comprise a heat-dissipation fan; and a shroud disposed around the heat-dissipation fan, wherein the blocking member is in contact with each of the shroud and heat-dissipation cover. The blocking member may be provided between the shroud and the heat-dissipation cover.

The heat-dissipation cover may include a cover body; and a suction grill mounted on the cover body, wherein the suction grill has an outer intake hole defined therein, wherein the blocking member is disposed in contact with the cover body.

In one implementation of the first aspect, the suction grill comprises a mesh composed of a plurality of wires, wherein a thickness of each wire is not less than 1 mm and not more than 1.6 mm.

In one implementation of the first aspect, the cover body includes a depressed portion depressed in a rear direction, wherein the suction grill is mounted on the depressed portion, wherein the blocking member is disposed in contact with the depressed portion.

In one implementation of the first aspect, the blocking member is made of a porous material.

In one implementation of the first aspect, the outer intake hole includes a plurality of holes, wherein a distance between adjacent holes is 1 mm or more and 1.5 mm or less.

In one implementation of the first aspect, the outer intake hole includes a plurality of holes, wherein a distance between centers of adjacent holes is 7 mm or more and 10 mm or less.

In one implementation of the first aspect, the outer intake hole includes a plurality of holes, wherein each of the holes is formed in a circular shape having a diameter of 7 mm or more and 8 mm or less.

In a second aspect of the present disclosure, there is provided a refrigerator comprising: a cabinet including a back plate; an inner case disposed in front of the back plate, wherein the inner case has a storage chamber defined therein; a thermoelectric module, wherein thermoelectric module includes a thermoelectric element, a cooling sink mounted on a first face of the thermoelectric element and configured to cool the storage chamber, and a heat sink mounted on a second face of the thermoelectric element, wherein the first face is opposite to the second face; a heat-dissipation cover spaced apart from the back plate in a rear direction, wherein the heat-dissipation cover has a plurality of outer intake holes defined therein; a fan provided between the outer intake holes and the heat sink; a shroud provided around the fan; and a blocking member configured to block a gap between the shroud and the heat-dissipation cover. The blocking member may be spaced apart from the heat sink.

The blocking member may have a ring shape extending along a circumference of the shroud.

A front end of the blocking member may abut a rear end of the shroud, wherein a rear end of the blocking member abuts a front end of the heat-dissipation cover.

The blocking member may surround at least a portion of an outer circumference of the shroud. A length of the blocking member in a rear-front direction may be greater than a length of the blocking member in a radial direction. The length of the blocking member in the rear-front direction may be between 15 mm and 20 mm, while the length of the blocking member in the radial direction may be between 5 mm and 10 mm.

A refrigerator may comprise a storage chamber configured to store food therein; a cooled-air flow channel positioned behind the storage chamber, wherein the channel is in communication with the storage chamber; a rear dissipated-heat flow channel positioned behind the cooled-air flow channel; a lower dissipated-heat flow channel communicating with the rear dissipated-heat flow channel, wherein the lower dissipated-heat flow channel is positioned below the storage chamber and is configured to eject air in a forward direction; a thermoelectric module including a cooling sink, a heat sink and a thermoelectric element, wherein the cooling sink is arranged in the cooled-air flow channel, wherein the heat sink is arranged within the rear dissipated-heat flow channel, wherein the thermoelectric element is located between the cooling sink and the heat sink; a heat dissipation cover located behind the rear dissipated-heat flow channel to cover the rear dissipated-heat flow channel, wherein the heat dissipation cover has a plurality of outer intake holes defined therein; a heat-dissipation fan assembly including a fan and a shroud, wherein the fan is located between the outer intake holes and the heat sink, wherein the shroud surrounds the fan and is spaced apart from the heat-dissipation cover; and a blocking member configured to block a gap between the shroud and the heat-dissipation cover. The blocking member may have an annular shape extending along a circumference of the shroud, wherein the plurality of the outer intake holes communicate with an inner space in the blocking member in a rear-front direction.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A thermoelectric refrigerator comprising:

a cabinet including a bottom plate and a back plate;

an inner case having a storage chamber defined therein and disposed in the cabinet adjacent to the back plate;

a door configured to open and close the storage chamber and spaced above the bottom plate;

a thermoelectric module provided adjacent to the storage chamber and configured to cool the storage chamber, wherein the thermoelectric module includes a thermoelectric element, a heat sink, and a cooling sink;

a heat-dissipation fan assembly provided adjacent to the heat sink; and a heat-dissipation cover provided adjacent to and spaced apart from the inner case in a first direction, wherein the heat-dissipation cover includes at least one outer intake hole which faces the heat-dissipation fan assembly;

a gasket configured to block a gap between the heat-dissipation cover and the heat-dissipation fan assembly, wherein the back plate has a through-hole, the inner case has a thermoelectric module mounting hole, and the through-hole of the back plate is provided at a position corresponding to the thermoelectric module mounting hole of the inner case, wherein the thermoelectric element and the cooling sink are positioned in front of the through-hole, while the heat sink is partially located behind the through-hole, wherein the heat-dissipation fan assembly is to face the heat sink at a rear of the heat sink, and comprise at least one fixing pin, and wherein the fixing pin is to contact the heat sink and separates the heat-dissipation fan assembly from the heat sink, wherein the fixing pin comprising:

a head to contact the heat sink, a pin body to be disposed in the heat-dissipation fan assembly, a fixing portion to be fixed to a shroud of the heat-dissipating fan assembly while being in contact with a rear face of the shroud, and an extension to couple with the heat-dissipation cover or to pass through the heat-dissipation cover, wherein the heat-dissipation cover includes a suction grill formed of a mesh having a plurality of wires, wherein a thickness of each wire is between 1 mm and 1.6 mm, wherein the thermoelectric refrigerator further comprises:

a fan configured to circulate air, which has exchanged heat with the cooling sink, to the storage chamber;

a fan cover configured to cover the fan and having an upper discharge hole, a lower discharge hole, and an inner suction hole formed between the upper discharge hole and the lower discharge hole;

a first receiving member disposed in the storage chamber; and a second receiving member disposed over the first receiving member to be spaced apart from the first receiving member, the second receiving member including a rear face facing the upper discharge hole, and at least a portion of the rear face is an inclined face configured to guide air ejected from the upper discharge hole to a top of the storage chamber, wherein the inner suction hole does not horizontally overlap each of the first receiving member and the second receiving member, and wherein a lower portion of the upper discharge hole horizontally overlaps the second receiving member, and an upper portion of the upper discharge hole horizontally overlaps a space between a top face of the storage chamber and the second receiving member, wherein a first spaced distance between the rear face of the second receiving member and a rear surface of the storage chamber is greater than a second spaced distance between the first receiving member and the rear surface of the storage chamber.

2. The thermoelectric refrigerator of claim 1, further comprising:

an electronic component disposed above the heat sink; and a barrier disposed between the electronic component and the heat sink, wherein the electronic component and the barrier are disposed between the back plate and the heat-dissipation cover.

3. The thermoelectric refrigerator of claim 1, further comprising:

a cabinet bottom located inside the cabinet and configured to support the inner case from below, and a lower dissipated-heat flow channel defined between the cabinet bottom and the cabinet.

4. The thermoelectric refrigerator of claim 3, comprising a tray arranged between the cabinet bottom and the bottom plate.

5. The thermoelectric refrigerator of claim 1, further comprising:

a drain pipe that communicates with the storage chamber and is connected to a lower portion of the inner case, a tray configured to receive water dropped from the drain pipe and positioned below the drain pipe.

6. The thermoelectric refrigerator of claim 1, wherein a diameter of the head of the fixing pin is larger than a diameter of the pin body of the fixing pin, and a diameter of the extension of the fixing pin is smaller than or equal to a diameter of the fixing portion of the fixing pin.

7. The thermoelectric refrigerator of claim 1, wherein the heat sink comprises a heat-dissipation plate, a heat-dissipation pipe, and a heat-dissipation fin structure, wherein a fin of the heat-dissipation fin structure has a groove defined in a portion at which the heat-dissipation pipe is located, and the head of the fixing pin is to be inserted into the groove of the fin of the heat-dissipation fin structure.

8. The thermoelectric refrigerator of claim 1, further comprising:

a rear dissipated-heat flow channel defined between the back plate and the heat-dissipation cover, the heat sink and the heat-dissipation fan assembly are disposed in the rear dissipated-heat flow channel; and a lower dissipated-heat flow channel configured to communicate with the rear dissipated-heat flow channel and positioned below the storage chamber.

* * * * *